US012503839B2

(12) United States Patent
Greenly et al.

(10) Patent No.: US 12,503,839 B2
(45) Date of Patent: Dec. 23, 2025

(54) INCREASING PRODUCTION FROM WATER WELLS

(71) Applicant: THRU TUBING SOLUTIONS, INC., Newcastle, OK (US)

(72) Inventors: Richard C. Greenly, Edmond, OK (US); Roger L. Schultz, Ninnekah, OK (US); Andrew M. Ferguson, Moore, OK (US); Steven A Ariss, Boyers, PA (US); Nigel Rowcliffe, Mount Pleasant, MI (US); Toby Menard, New Orleans, LA (US); Micah Goodspeed, Oklahoma City, OK (US); Philippe Giacalone, Mount Pleasant, MI (US)

(73) Assignee: THRU TUBING SOLUTIONS, INC., Newcastle, OK (US)

( * ) Notice: Subject to any disclaimer, the term of this patent is extended or adjusted under 35 U.S.C. 154(b) by 0 days.

(21) Appl. No.: 18/828,880

(22) Filed: Sep. 9, 2024

(65) Prior Publication Data

US 2025/0101720 A1 Mar. 27, 2025

Related U.S. Application Data

(60) Provisional application No. 63/646,046, filed on May 13, 2024, provisional application No. 63/632,933,
(Continued)

(51) Int. Cl.
*E03B 3/15* (2006.01)
*E21B 4/02* (2006.01)
(Continued)

(52) U.S. Cl.
CPC ..... *E03B 3/15* (2013.01); *E21B 4/02* (2013.01); *E21B 7/04* (2013.01); *E21B 29/06* (2013.01);
(Continued)

(58) Field of Classification Search
CPC . E21B 7/04; E21B 7/06; E21B 47/024; E03B 3/15
See application file for complete search history.

(56) References Cited

U.S. PATENT DOCUMENTS 3,242,985 A 3/1966 North
3,406,766 A * 10/1968 Henderson ..... E21B 7/06 175/50
(Continued)

OTHER PUBLICATIONS

Halliburton, "Relief Well Planning & Magnetic Ranging," services brochure, 55 pages, dated Oct. 2020.
(Continued)

*Primary Examiner* — Jennifer H Gay
(74) *Attorney, Agent, or Firm* — Smith IP Services, P.C.

(57) ABSTRACT

A method of increasing production from at least one target wellbore can include drilling at least one offset wellbore having at least one horizontal portion in at least one aquifer, and intersecting the target wellbore with the offset wellbore. A water well system for improved production from at least one target wellbore can include at least one offset wellbore, the offset wellbore including at least one horizontal portion positioned in at least one aquifer, and at least one intersection between the offset wellbore and the target wellbore. Ranging equipment in the target and/or offset wellbore may be used to steer a coiled tubing drilling BHA in the offset wellbore toward the target wellbore.

35 Claims, 15 Drawing Sheets

Related U.S. Application Data filed on Apr. 11, 2024, provisional application No. 63/632,140, filed on Apr. 10, 2024, provisional application No. 63/585,483, filed on Sep. 26, 2023.

(51) Int. Cl.

| | |
|---|---|
| ***E21B 7/04*** | (2006.01) |
| ***E21B 29/06*** | (2006.01) |
| ***E21B 33/13*** | (2006.01) |
| ***E21B 47/024*** | (2006.01) |
| ***E21B 47/12*** | (2012.01) |

(52) U.S. Cl.
CPC ..... *E21B 33/13* (2013.01); *E21B 47/024* (2013.01); *E21B 47/12* (2013.01)

(56) References Cited

U.S. PATENT DOCUMENTS 5,059,064 A * 10/1991 Justice ..... E02F 5/10 239/20
5,074,365 A * 12/1991 Kuckes ..... E21B 47/0228 175/45
5,230,387 A 7/1993 Waters et al.
5,289,888 A * 3/1994 Talley ..... E21B 43/32 166/50
5,343,965 A * 9/1994 Talley ..... E21B 23/01 166/380
5,396,950 A * 3/1995 Talley ..... E21B 17/08 175/73
5,771,976 A * 6/1998 Talley ..... E03B 3/14 166/50
6,135,206 A 10/2000 Gano
6,695,056 B2 2/2004 Haugen
6,856,255 B2 2/2005 Chalitsios
7,036,584 B2 * 5/2006 Zupanick ..... E21B 43/006 166/50
7,360,595 B2 * 4/2008 Zupanick ..... E21B 41/0064 166/279
7,493,951 B1 * 2/2009 Kravits ..... E21B 43/006 166/50
7,513,304 B2 * 4/2009 Stayton ..... E21B 43/30 166/50
7,571,771 B2 * 8/2009 Pratt ..... E21B 43/121 166/50
8,297,377 B2 * 10/2012 Zupanick ..... G01V 1/48 175/71
8,333,245 B2 * 12/2012 Zupanick ..... E21B 43/305 166/50
8,376,039 B2 * 2/2013 Zupanick ..... E21B 43/006 166/263
8,376,052 B2 * 2/2013 Zupanick ..... E21B 7/046 166/50
8,919,441 B2 12/2014 Parlin
9,145,767 B2 * 9/2015 Borges ..... E21B 43/305
9,644,463 B2 * 5/2017 Dallas ..... E21B 43/16
10,018,004 B2 7/2018 Abrant
10,125,561 B2 11/2018 Cramm
10,294,777 B2 5/2019 Jarman et al.
10,392,929 B1 8/2019 Servin
10,487,644 B2 * 11/2019 Hess ..... E21B 47/0228
11,365,585 B1 * 6/2022 Watson ..... E21B 7/046
11,852,384 B2 * 12/2023 Toews ..... E21B 47/0228
2002/0096336 A1 * 7/2002 Zupanick ..... E21F 7/00 166/370
2002/0189801 A1 * 12/2002 Zupanick ..... E21B 7/046 166/50
2004/0050554 A1 * 3/2004 Zupanick ..... E21B 43/13 166/50
2004/0108110 A1 * 6/2004 Zupanick ..... E21B 43/00 166/245
2005/0087340 A1 * 4/2005 Zupanick ..... E21B 41/0064 166/50
2006/0266517 A1 * 11/2006 Stayton ..... E21B 43/30 175/57
2006/0266521 A1 * 11/2006 Pratt ..... E21B 43/04 166/278
2009/0084534 A1 * 4/2009 Zupanick ..... E21B 43/305 166/50
2009/0095530 A1 * 4/2009 Waters ..... E21B 7/04 175/45
2009/0120691 A1 * 5/2009 Waters ..... E21B 7/04 175/45
2010/0018770 A1 1/2010 Moriarty et al.
2012/0205159 A1 * 8/2012 Borges ..... E21B 43/305 175/73
2013/0153224 A1 6/2013 Parlin
2014/0174740 A1 6/2014 Parlin
2014/0367170 A1 * 12/2014 Hoehn ..... E21B 47/02 175/45
2015/0027714 A1 1/2015 Parlin
2016/0259079 A1 9/2016 Wilson
2017/0248006 A1 * 8/2017 Hess ..... G01V 3/26
2019/0071939 A1 3/2019 Zheng et al.
2021/0285323 A1 9/2021 Davis
2022/0003459 A1 * 1/2022 Toews ..... E21B 36/001
2022/0090484 A1 3/2022 Moss
2025/0101720 A1 * 3/2025 Greenly ..... E21B 29/06
2025/0101809 A1 * 3/2025 Menard ..... E21B 47/024
2025/0101810 A1 * 3/2025 Rowcliffe ..... E21B 47/12

OTHER PUBLICATIONS

ISCWSA, "Wellbore Ranging Technologies, Intercept Applications and Best Practices," dated 2016, 103 pages.
James Roberts, "Are Horizontal Wells Right for Development of Groundwater Resources in the Garber-Wellington Aquifer?," dated 2019, 11 pages.
Office Action issued Jul. 21, 2025 for U.S. Appl. No. 18/891,667, 27 pages.

* cited by examiner

INCREASING PRODUCTION FROM WATER WELLS

CROSS-REFERENCE TO RELATED APPLICATIONS

This application claims the benefit of the filing dates of U.S. provisional application Nos. 63/585,483 filed 26 Sep. 2023, 63/632,140 filed 10 Apr. 2024, 63/632,933 filed 11 Apr. 2024, and 63/646,046 filed 13 May 2024. The entire disclosures of these prior applications are incorporated herein by this reference for all purposes.

BACKGROUND

This disclosure relates generally to equipment utilized and operations performed in conjunction with a subterranean well and, in an example described below, more particularly provides for increasing production from water wells.

When a water well is initially put in production, typically the volume and flow rate of water from the well are sufficient to satisfy the existing demand for the water. However, the rate of production from the well may decline over time, or the demand for water production may increase over time.

For these and other reasons, there exists a need for increasing production from water wells. The present disclosure provides such increased water production, using a variety of different wellbore configurations, for use with existing or newly constructed water wells.

DETAILED DESCRIPTION

Figure 1:
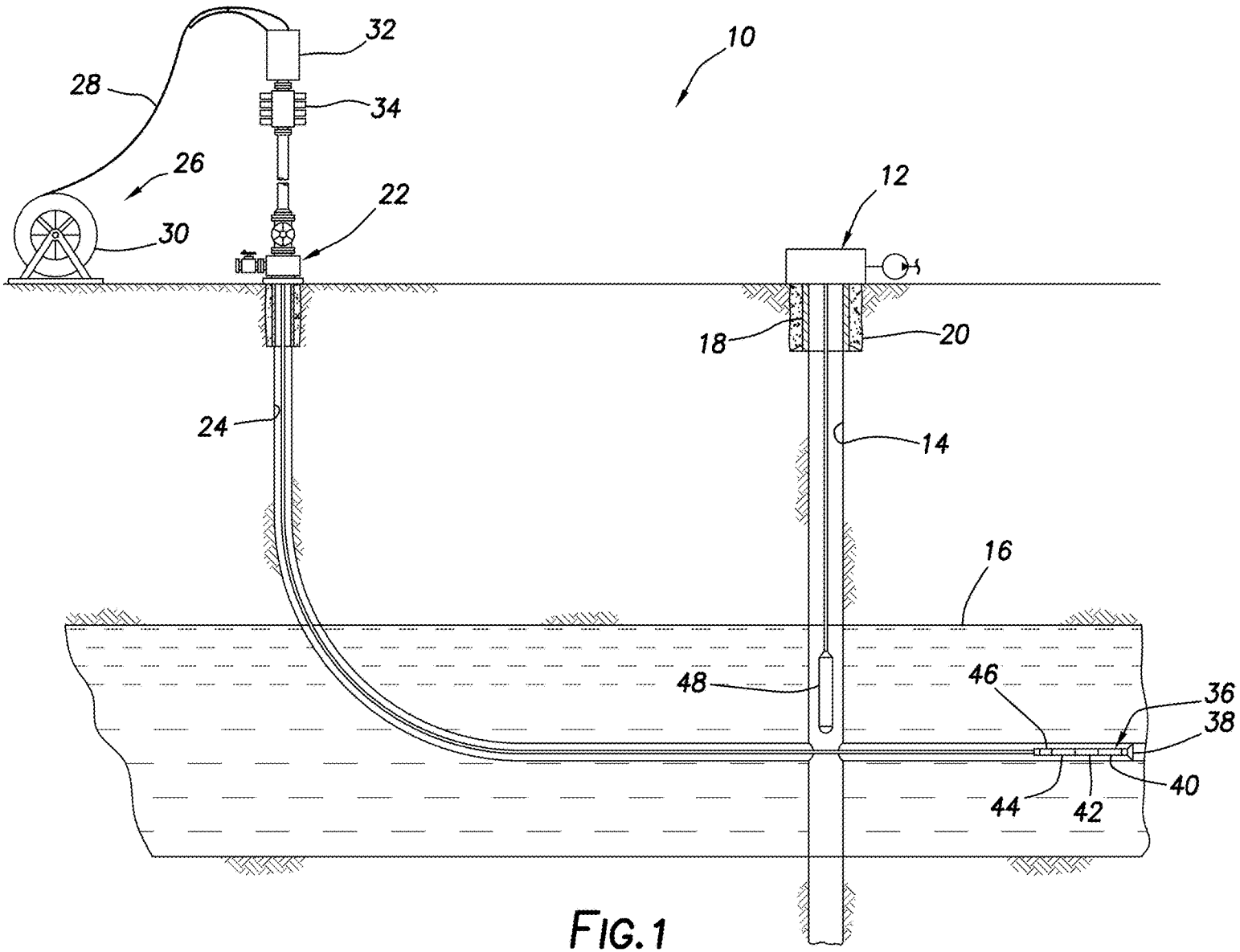
FIG. 1 is a representative partially cross-sectional view of an example of a well system and associated method which can embody principles of this disclosure.

Representatively illustrated in the accompanying drawings are examples of water well systems and associated methods which can embody principles of this disclosure. However, it should be clearly understood that the systems and methods are merely specific examples of applications of the principles of this disclosure in practice, and a wide variety of other examples are possible. Therefore, the scope of this disclosure is not limited at all to the details of the systems and methods described herein and/or depicted in the drawings.

In one aspect, this disclosure describes methods of intersecting a water well with one or more generally horizontal wellbores. As used herein, the term "horizontal" is used to indicate a wellbore that is highly deviated (e.g., >60 degrees) from vertical. It is not necessary for a horizontal wellbore to be oriented exactly 90 degrees from vertical. In other examples, the intersecting wellbore(s) may not be horizontal where it/they intersect the water well.

Water wells are typically of vertical construction. As used herein, the term "vertical" is used to indicate a wellbore that is vertical or nearly vertical (that is, not highly deviated from vertical, e.g., <10 degrees from vertical). It is not necessary for a vertical wellbore to be oriented exactly vertical.

The production capability of a water well is generally proportional to a linear contact length of a wellbore with the producing aquifer. In a vertical well, the linear contact length is limited by the height of the producing aquifer. In a horizontal wellbore, long intervals of contact with the aquifer can be maintained by drilling horizontally in the production zone. Several new horizontal water well configurations and methods of constructing them are described herein.

In addition to the possible increased production rates, horizontal water wells cover a larger drainage area resulting in faster recovery from being pulled hard (produced at a relatively high flow rate). Plus, the larger drainage area provides the ability to pull more water from the plane of the horizontal, whereas a vertical well is more likely to pull fluid from lower in the aquifer. Horizontal wells have the potential to produce a higher quality of water.

In one aspect, a fundamental concept of this disclosure is to create one or more horizontal production zones in a producing aquifer that are connected to a vertical production or "target" wellbore by drilling at least one additional secondary or "offset" wellbore from the surface which is separate from the main production wellbore, but intersects the main wellbore with a horizontal section. FIG. 1 Illustrates this concept.

As used herein, the term "offset" is used to indicate a well having a wellbore which is, at the surface, spaced apart from a previously drilled wellbore. An offset wellbore is drilled from an offset well, although an offset wellbore does not necessarily extend to the surface (such as, a lateral offset wellbore drilled from a parent offset wellbore). As used herein, the term "target" is used to indicate a well having a wellbore which is to be intersected by a subsequently drilled wellbore.

As used herein, the term "intersect" and similar terms (such as, intersecting, intersected, etc.) is used to indicate full or substantially full fluid communication between target and offset wellbores. It is not necessary for a target wellbore to be penetrated by an offset wellbore in order for the wellbores to be intersecting. For example, an offset wellbore could be drilled so that the offset wellbore passes in close proximity to the target wellbore, and then perforations could be formed (e.g., using abrasive jets or explosive shaped charges) to establish fluid communication between the wellbores. In some examples, if the target wellbore is cased at the intended intersection, an abrasive jet could be used to form a pilot hole or ledge (e.g., a partial cut into the casing) in the target casing, in order to aid in later milling through the casing from the offset wellbore.

In some examples, a horizontal water well can be drilled without any intersections. For example, an artesian flowing aquifer could be drilled into with a conventional horizontal wellbore with single or multiple legs (lateral wellbores). Also, some well locations may not permit an intersection (e.g., in the middle of a developed area), such that it may be advantageous to drill one or more horizontal wellbores from the primary production well. If the production well needs large casing, a 5½" casing string could be set to drill the lateral(s), and then the casing could be pulled, if desired, once drilling is complete.

Another aspect of this disclosure comprises a method of drilling a secondary well that has a horizontal section that intersects a main production wellbore and then continues beyond the intersected wellbore to create additional horizontal production wellbore that is in fluid communication with the original main wellbore. The vertical portion of the secondary wellbore can then be plugged and abandoned, leaving the horizontal section of the secondary wellbore open and in communication with the main wellbore.

Note that it is not necessary for the secondary or offset wellbore to continue beyond the main or target wellbore, or for the offset wellbore to be horizontal after it intersects the target wellbore.

There are many possible variations of this method. Some potential well construction geometries (viewed from above) are shown in FIGS. 2A-J.

The horizontal wellbores can be constructed using drilling equipment that includes a steerable motor bottom hole assembly (BHA). One possibility is the use of coiled tubing with a mud motor (e.g., a Moineau-type or turbine fluid motor) driven with surface pumps. Instrumentation contained in the BHA makes it possible to determine a three-dimensional location of the drilling assembly, making it possible to precisely steer the BHA in such a way as to create the horizontal wellbore in a desired path and location.

Additionally, sensors in the BHA make it possible to determine if the BHA is inside the production formation. If measurements indicate that the BHA is starting to leave the production formation, steering adjustments can be made that cause the wellbore to move back into the production formation.

Ranging equipment can be used to steer the BHA towards the main wellbore so that the secondary wellbore intersects the main wellbore. This ranging equipment can be active or passive in nature and can have a source located in the main wellbore for detection by the ranging equipment in the drilling BHA.

In situations where access to the target wellbore is unavailable, current injection may be a suitable ranging technique, with the current being injected into the formation from the offset wellbore, or with the current being induced in the target wellbore (such as, in the casing). In situations where access to the target wellbore is available, a rotating magnet may be used in the offset wellbore drilling BHA, with a sensor package (e.g., including a magnetometer) deployed into the target wellbore.

In many municipalities the landscape is crowded with many small portions of land owned by many different entities. This makes it difficult to secure the right to construct a long horizontal section of water well in these crowded urban areas.

However, local municipalities often have easements associated with roadways or other relatively long uninterrupted geometric shapes (such as, power lines or railways). This makes it feasible for municipalities to construct long horizontal water wellbore sections underneath these geographical features, even in crowded metropolitan areas.

Figure 5:
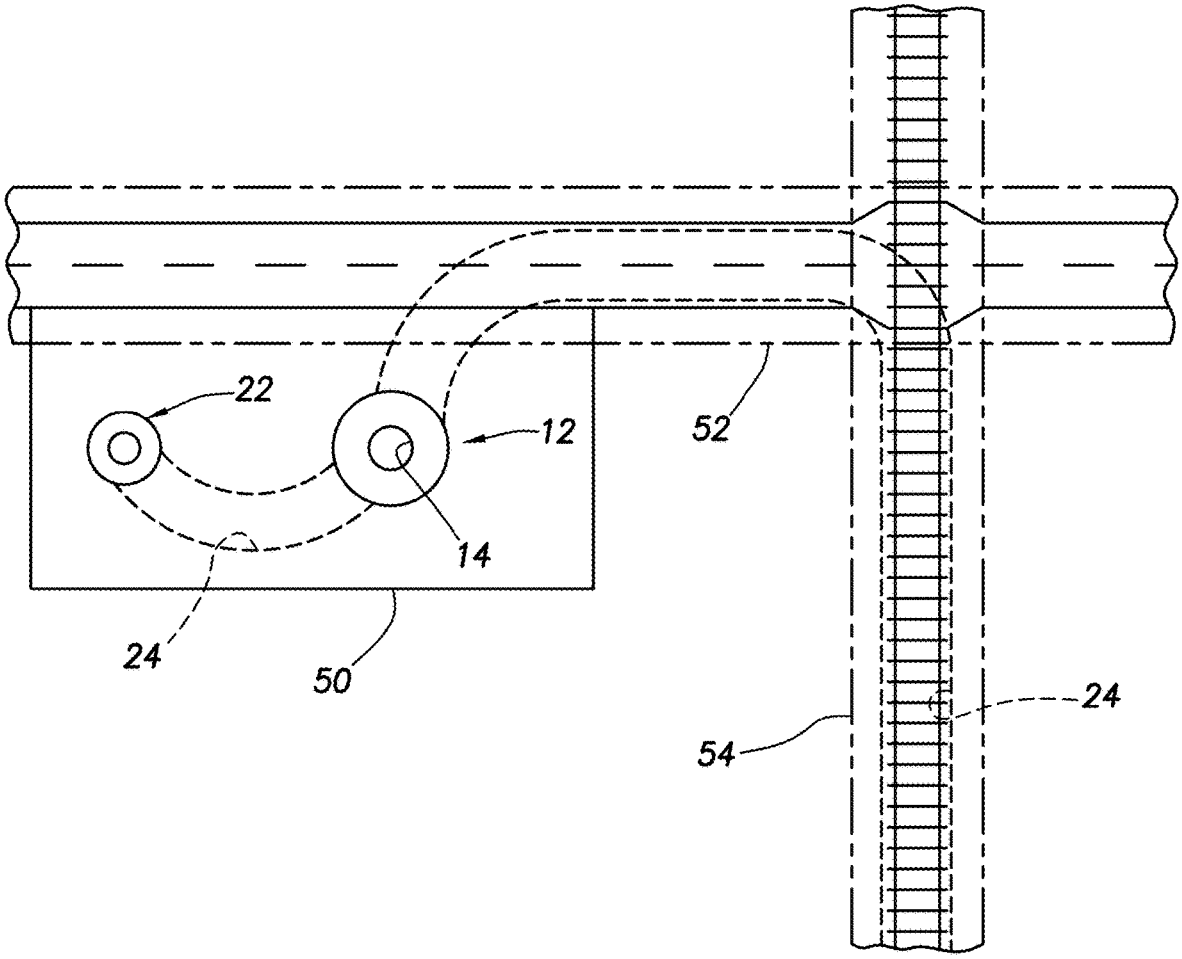
FIG. 5 is a representative plan view of another example wellbore configuration.

For instance, a municipal water supply facility likely has direct access to a roadway. The desired secondary well could be located on the municipal property. The horizontal section of the municipality's secondary wellbore could then be "steered," so as to intersect the main wellbore, and then be steered off the municipal property and underneath the nearby roadway. The majority of the horizontal production zone intersected by the secondary wellbore could then be positioned underneath the roadway or other potential property. FIG. 5 illustrates this.

Figure 4:
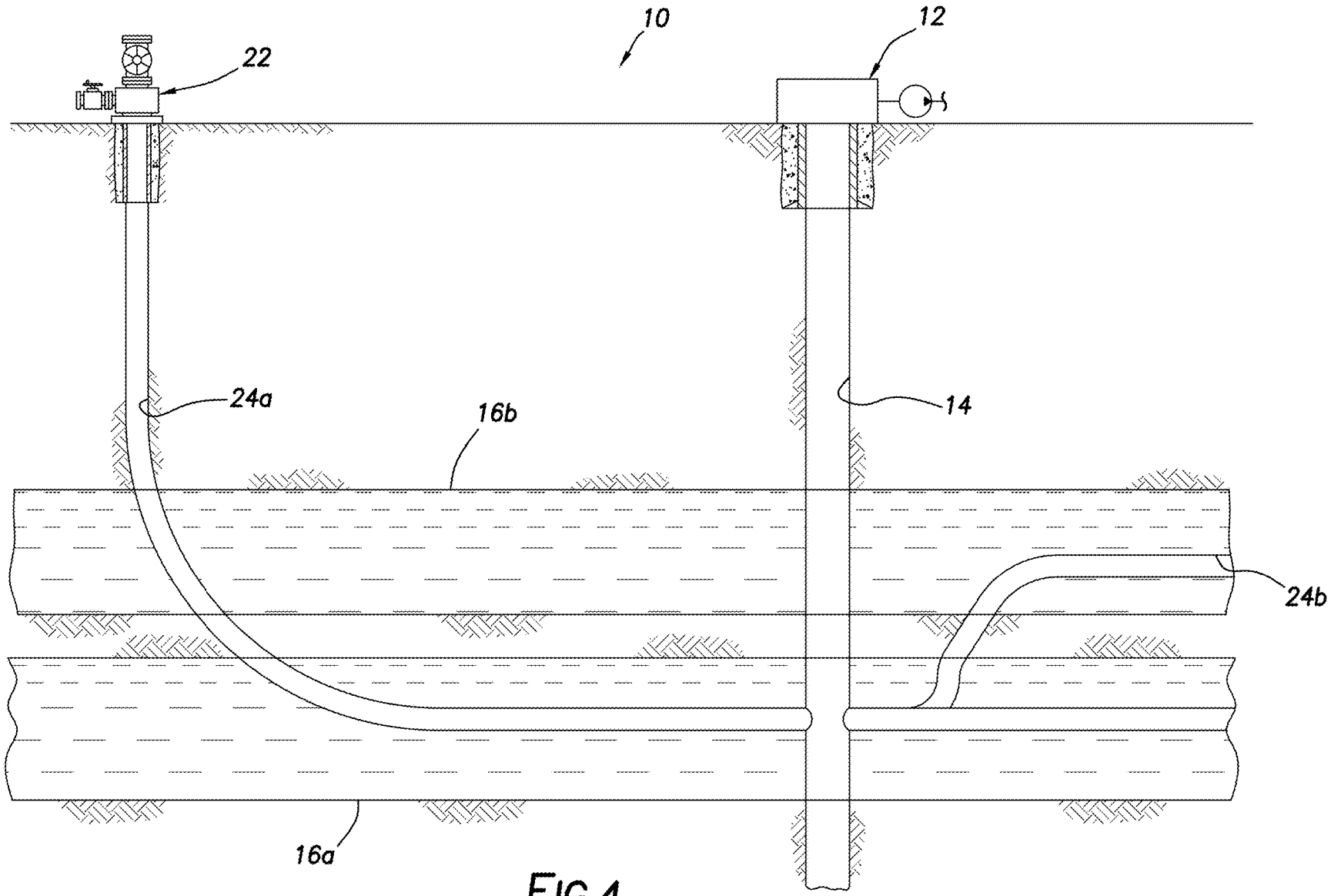
Figure 6:
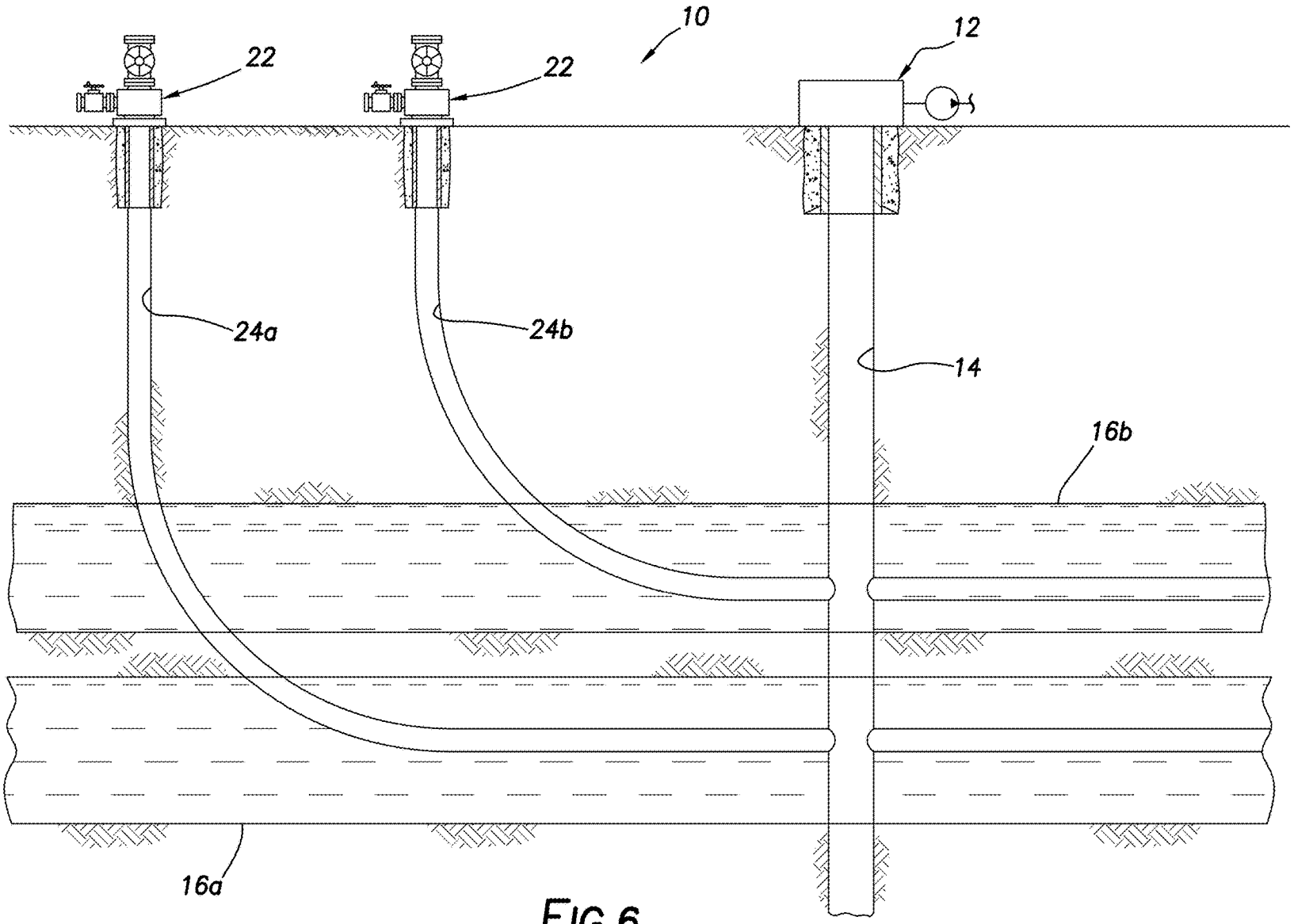
FIGS. 6-13 are representative partially cross-sectional views of additional example wellbore configurations.

The methods described herein can also be used where there are multiple production aquifers, examples of which are depicted in FIGS. 4 & 6.

Figure 7:
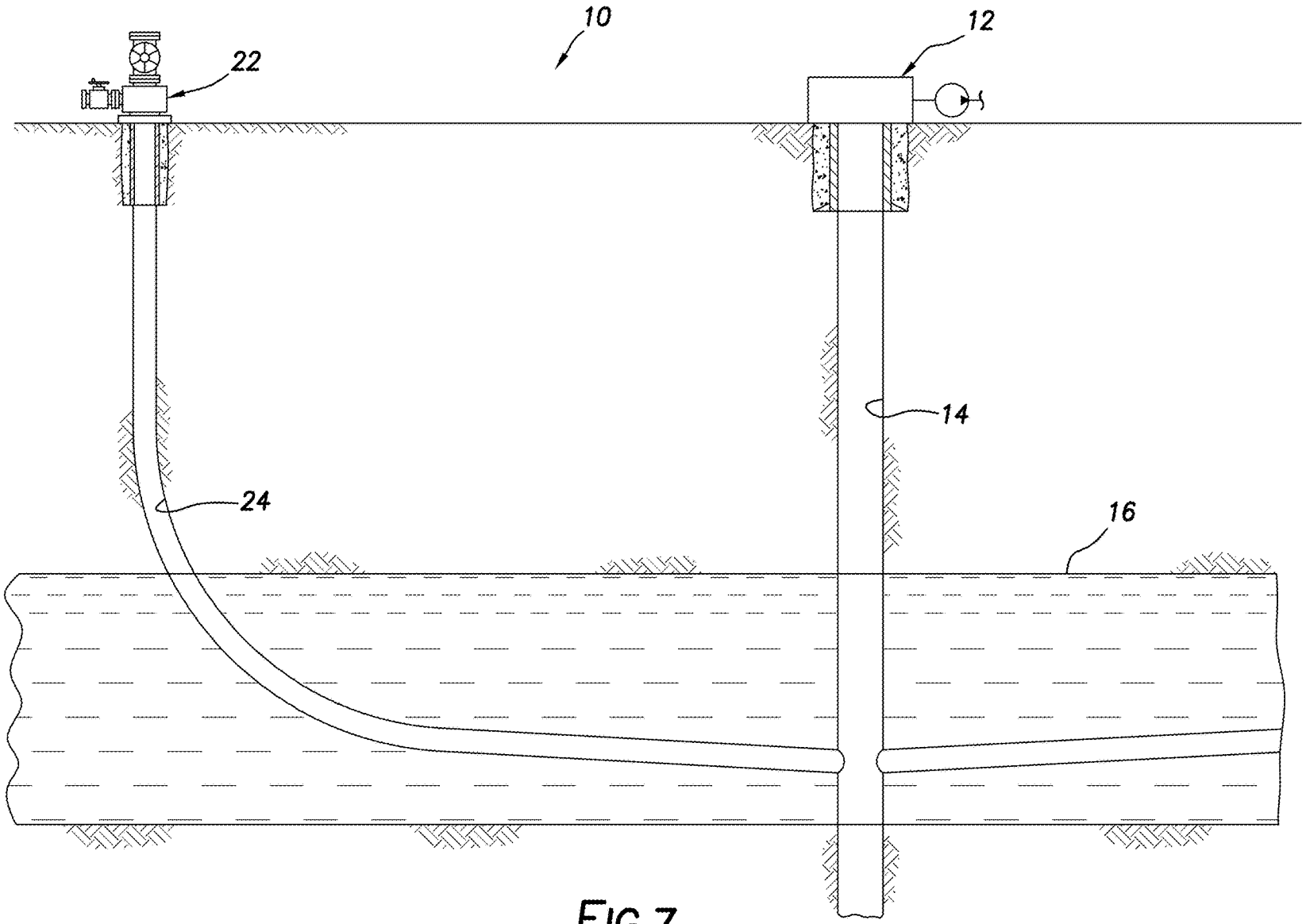

In the example depicted in FIG. 7, the offset wellbore is inclined downward toward the target wellbore both before and after (on both sides of) the intersection between the offset and target wellbores. In this manner, fluids from the producing zone can drain through the offset wellbore toward the target wellbore under the influence of gravity. In some examples, the offset wellbore can remain in the producing zone (such as, an aquifer) both before and after the intersection.

Figure 8:
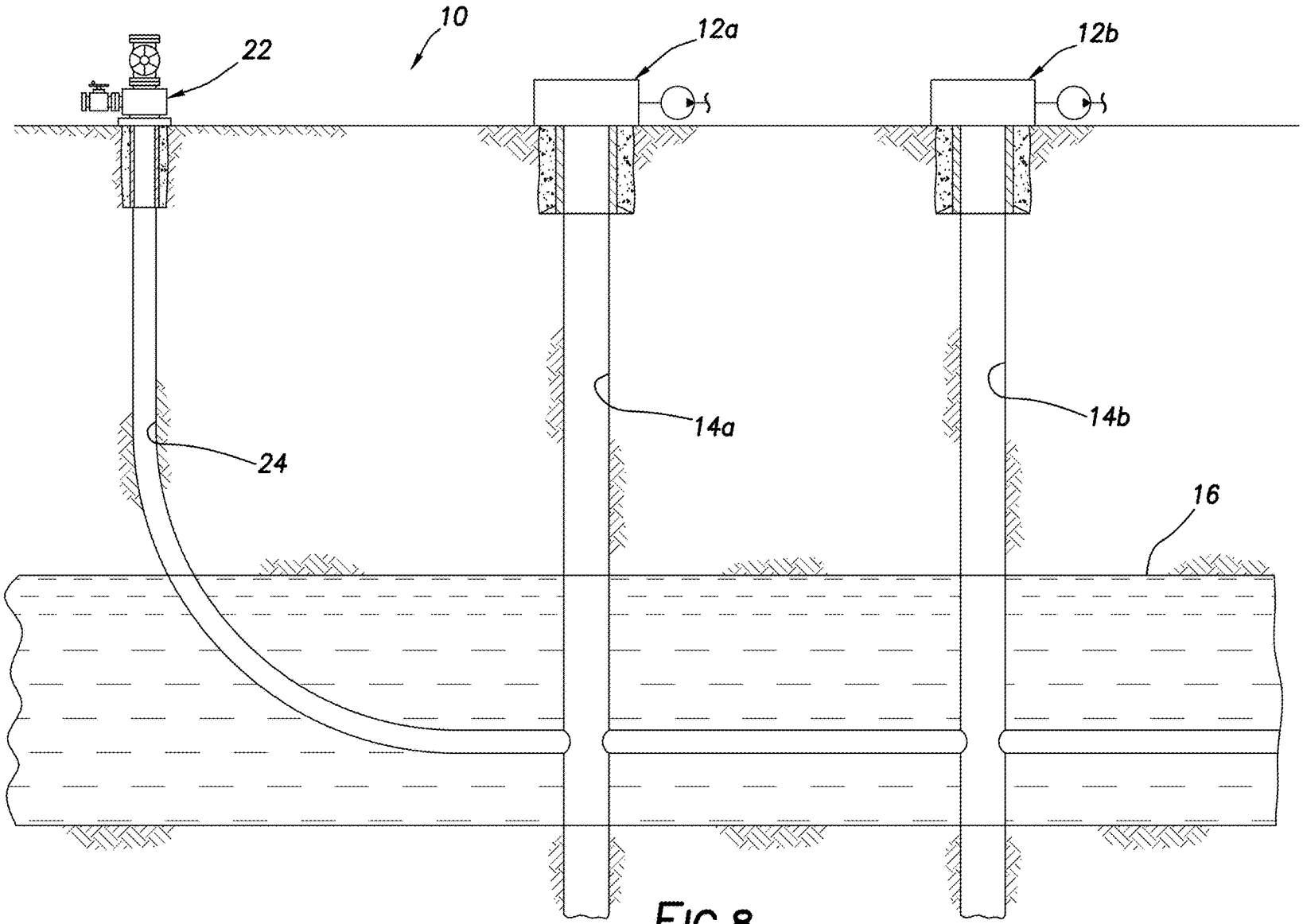
Figure 9:
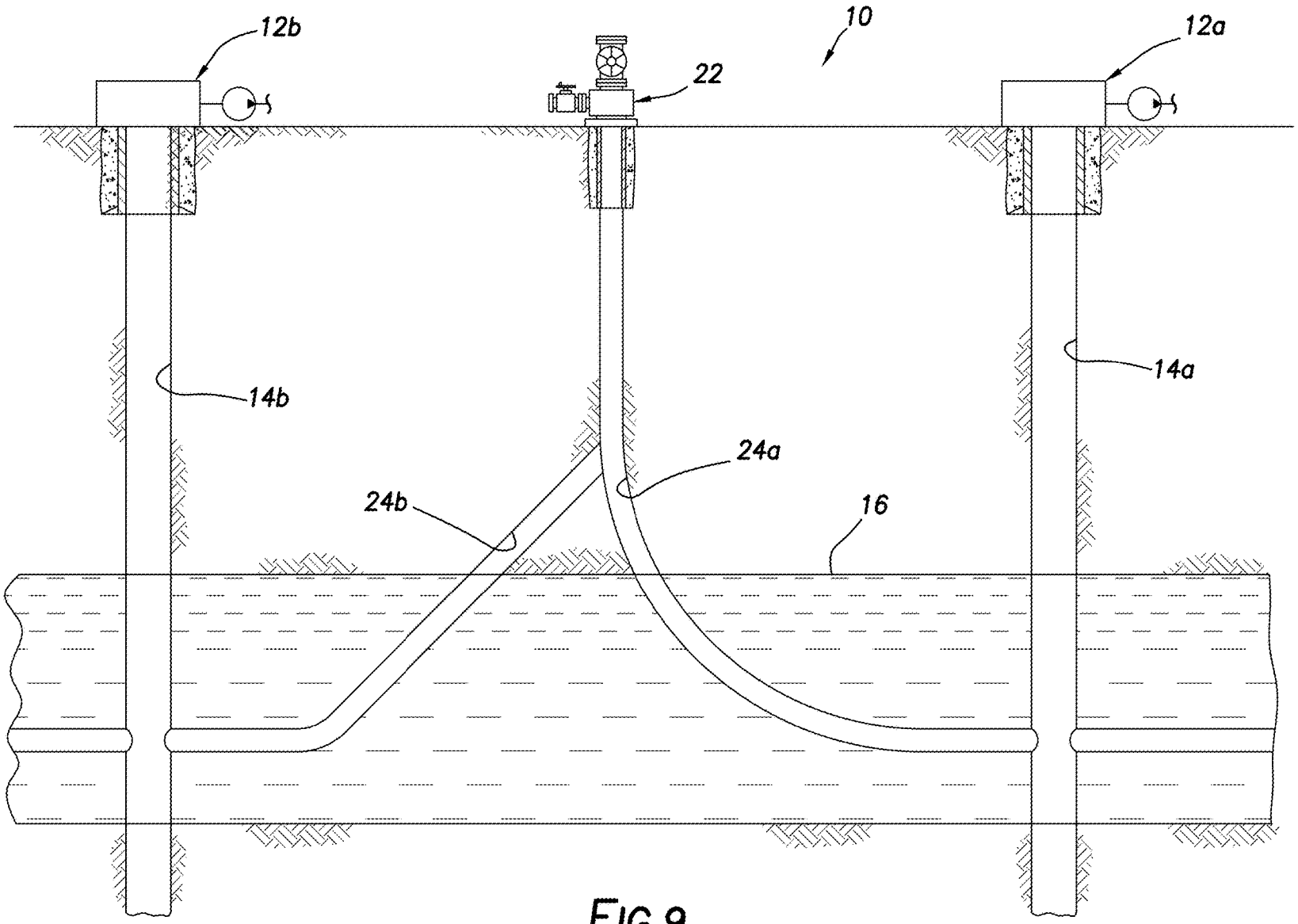
Figure 13:
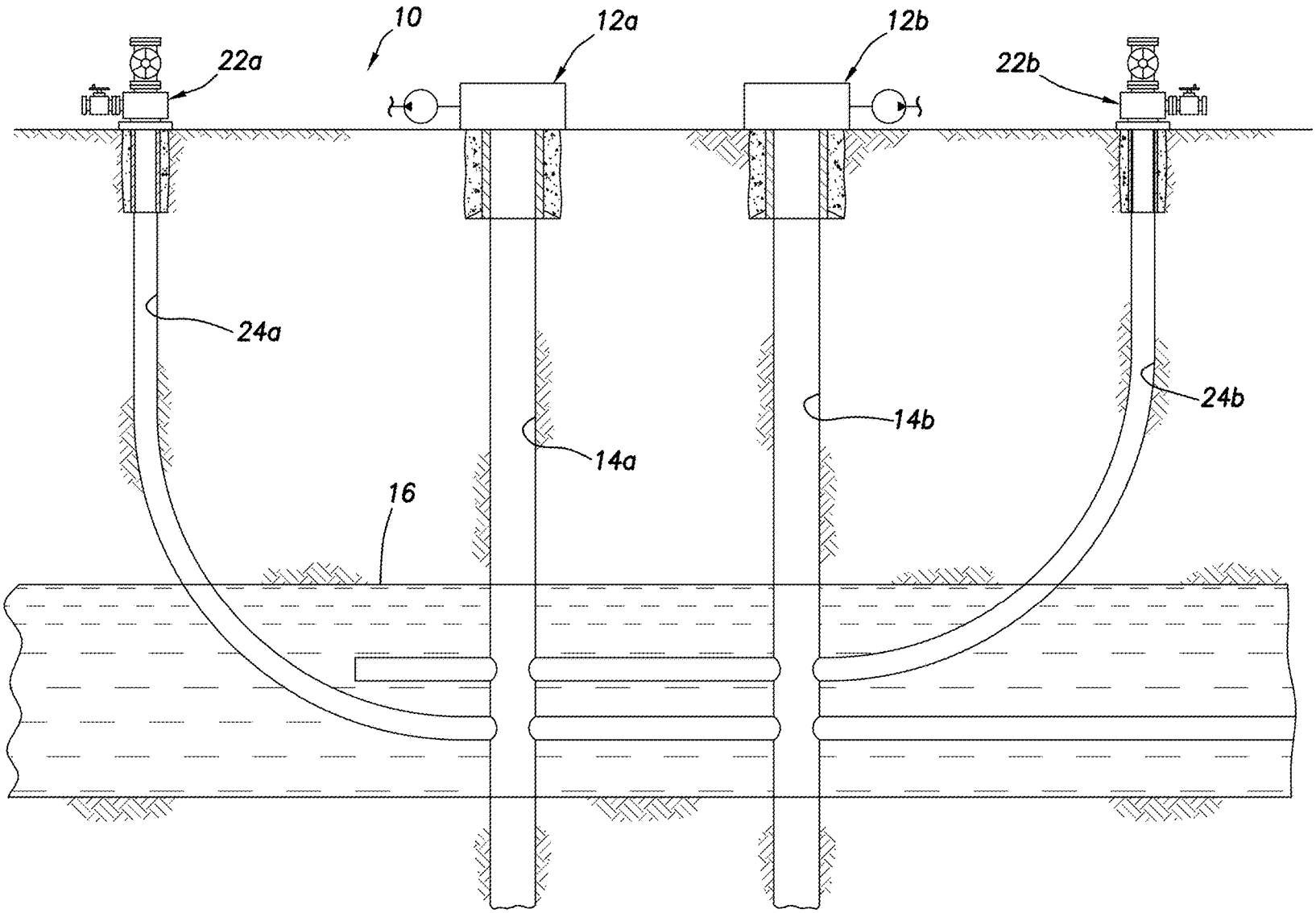

In examples depicted in FIGS. 8, 9 & 13, multiple target wells are intersected by a single offset well. In FIG. 8, a single offset wellbore intersects multiple target wellbores. In FIG. 9, the offset well has a wellbore extending to the surface, and a sidetrack or lateral wellbore, each of which intersects a target wellbore. In FIG. 13, each of multiple offset wellbores intersects multiple target wellbores in an aquifer.

Figure 10:
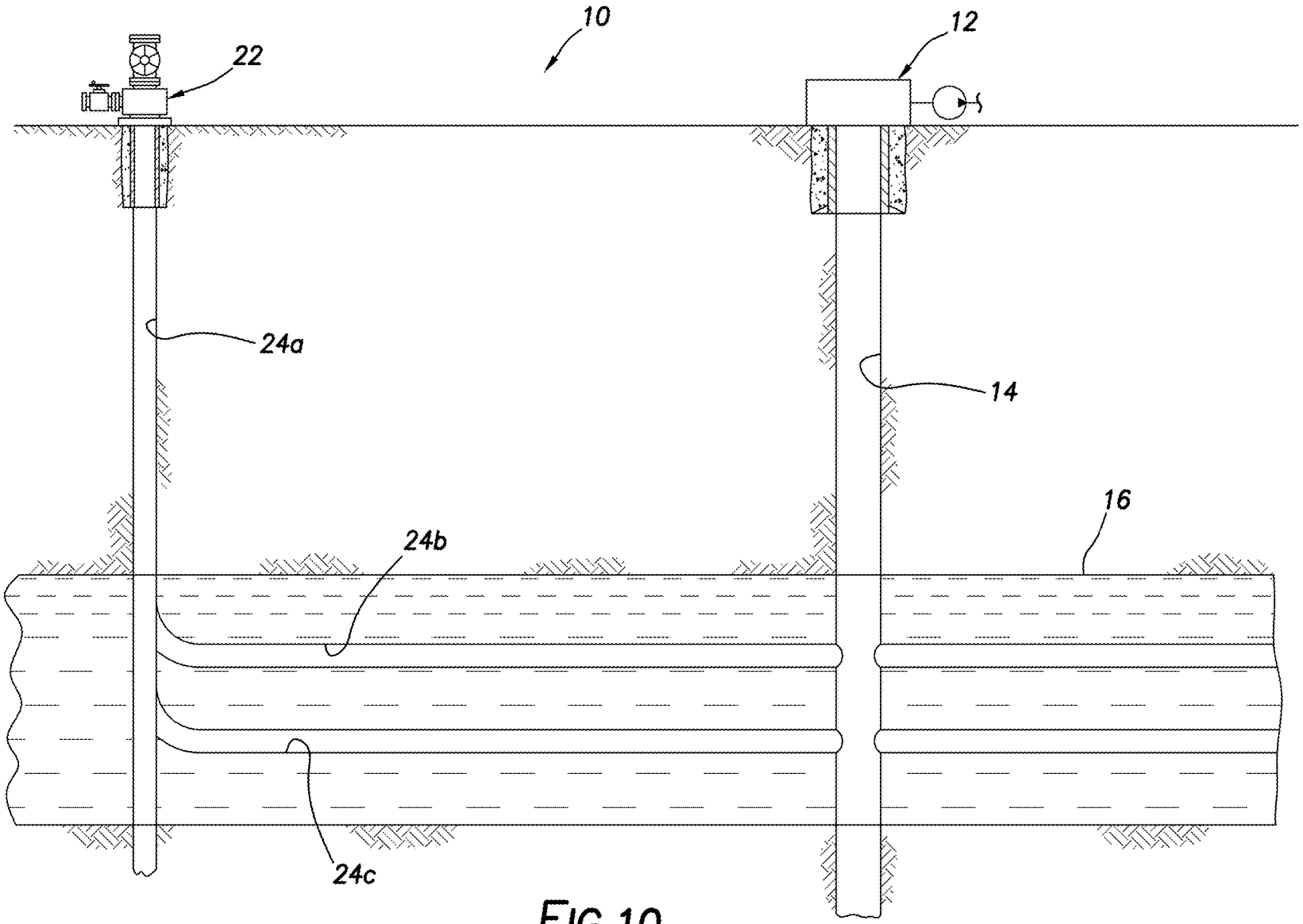
Figure 11:
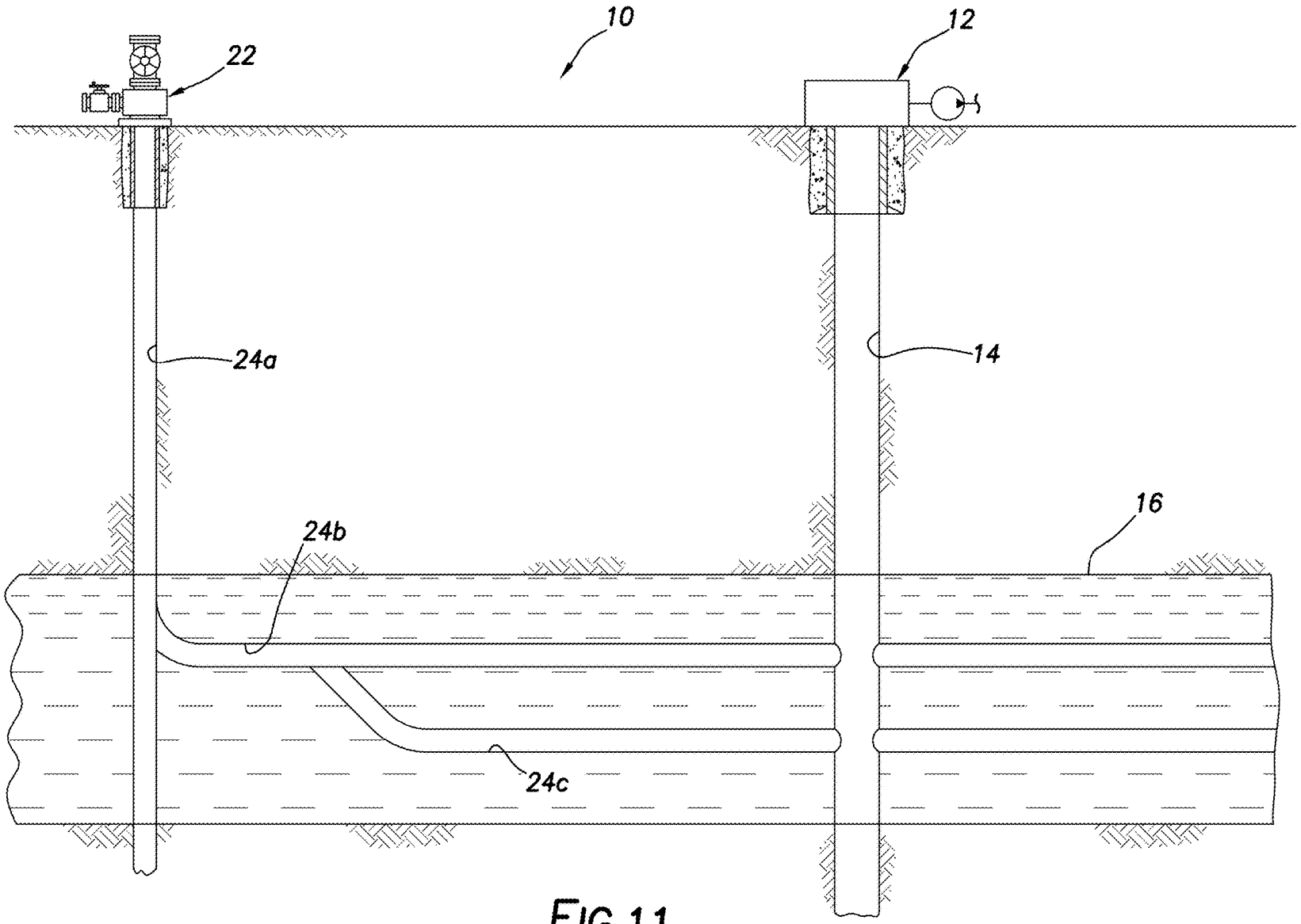

In examples depicted in FIGS. 10 & 11, there are multiple intersections between the target and offset wells, using multiple wellbores of the offset well. In FIG. 10, the offset well includes multiple lateral wellbores that intersect the target wellbore, with the lateral wellbores extending from a same parent wellbore. In FIG. 11, the offset well includes multiple lateral wellbores, one of which extends from a parent wellbore, and the other of which extends from the first lateral wellbore. In these examples, the offset well lateral wellbores are drilled in the same producing zone, but in other examples the lateral wellbores may be drilled in different producing zones. If the offset well lateral wellbores are drilled in different producing zones, each zone can be produced independent of the other, for example, by setting a packer in the target wellbore between the lateral wellbores with tubing to the surface, so that one zone is produced via the tubing, and the other zone is produced via an annulus between the tubing and the target wellbore.

In examples depicted below in FIGS. 12 & 13, multiple offset wells intersect one or multiple target well(s). In the FIG. 12 example, multiple offset wellbores intersect a single target wellbore in a producing zone. In the FIG. 13 example, each of multiple offset wellbores intersects multiple target wellbores in a producing zone. The intersections could be in different zones (producing or non-producing) in other examples.

Another advantage of some example methods described herein is the fact that, because the main or target wellbore is still used as the point where water production at the surface occurs, much of the existing property and infrastructure used in the water production operation can continue to be used without the need to purchase additional property or completely new infrastructure.

Following is a partial list of concepts that are within the scope of this disclosure:

1. Drilling a secondary or "offset" wellbore that has a horizontal section that intersects a separate main or "target" wellbore and optionally continues past the main wellbore to create additional horizontal production wellbore after the intersection point. In some examples, the offset wellbore is horizontal both before and after it intersects the target wellbore. In some examples, the offset wellbore is in a desired water producing zone both before and after it intersects the target wellbore.

2. The use of active and/or passive ranging methods/equipment to intersect the target wellbore(s) with the offset wellbore(s). Any suitable ranging technique may be used, including but not limited to passive magnetic ranging (e.g., using remnant magnetism of the target wellbore casing, a magnetized casing joint or a magnet deployed into the target wellbore, which is sensed using a magnetometer included in the offset wellbore drill string) or active magnetic ranging (e.g., using current injection into the formation and/or to the target wellbore casing to produce a magnetic field that is sensed using a magnetometer included in the offset wellbore drill string, or using a rotating magnet in the offset wellbore drill string to produce an alternating magnetic field that is sensed using a magnetometer included in the target wellbore).

3. The use of many different secondary wellbore configurations and numbers of secondary wellbores to create increased water production from a main wellbore.

4. The use of roadway, railroad or other long geometry easements for construction of the horizontal production sections in secondary horizontal wellbores. In some examples, the easement geometry is not necessarily "long" (such as, beneath schools or other types of facilities).

5. The use of existing or new water production wells and/or facilities after enhancing water production as described herein.

6. The use of this method with more than one distinct water production formation in one main production well.

The present inventors have developed a unique system to install horizontal water wellbores for municipalities, utility companies, commercial, industrial, agricultural or private parties, etc., that targets clean portions of the aquifers and greatly increases flow potential of water wells.

There are approximately 148,000 public water systems in the United States utilizing water wells as the source of water. Many of these systems are well past their prime, diminishing in flow and failing. The municipalities are being required to replace this infrastructure. However, as the towns grew in population these water wells are now in mature areas of town where the room to drill new wells is very limited. Additionally, the Environmental Protection Agency requirements for clean drinking water continue to be more rigorous with regard to naturally occurring chemicals such as Arsenic and Radionuclides and the newly discovered manmade chemicals in the Per- and Polyfluoroalkyl substances (PFAS) groups.

This example method to install horizontal water wells solves these challenges and allows municipalities to continue using their ground water supplies as a source of water.

Although horizontal wells have been utilized in the oil and gas industry for some time, it has been the general belief that horizontal wells are not suitable for municipal water wells. Some of the challenges are that typical oil field equipment is just too big to use in an urban setting. Another challenge is that the horizontal wellbore would need to be installed at an angle not conducive for setting a submersible pump. Also, the bend radius of typical oil field horizontal wells are greater than the total depth of the typical municipal water well.

In one aspect, because of the unique nature of the horizontal municipal water well, advantages can be found in locating the well near existing electrical and pipeline infrastructure. In one example, when the best location is determined, a vertical test well is drilled to locate the best aquifer to drill the horizontal portion of the wellbore. Formation drilling samples are collected and correlated with the downhole electric geophysical logs, then formation water samples are collected to determine the water quality. When it is determined that the zone-specific aquifer (e.g., 20-60 feet or 6-18 m in thickness and less than 2000 feet or 600 m in depth) is a viable target for the horizontal wellbore(s), a large diameter (such as, 16 inch or 0.4 m diameter) vertical well is drilled and cased to a point just above (e.g., less than 20 feet or 6 m) the target zone.

The secondary wellbore in this example is drilled approximately 500-1000 feet or 150-300 m away adjacent to the vertical production wellbore. A 5½ inch or 14 cm diameter shallow (less than 200 feet or 61 m, for example) vertical pilot hole is drilled for a coiled tubing rig to enter. The coiled tubing rig is capable of drilling through the vertical pilot hole and gradually drilling horizontally through the target zone to the main wellbore. The coiled tubing rig can also drill sidetracks or lateral wellbores from the secondary wellbore (e.g., as depicted in FIGS. 2I-4). In other examples, a 3⅞ inch or 10 cm water well could be drilled out of 4½ inch or 11.4 cm casing, or a 6⅛ inch or 15.5 cm water well could be drilled out of 7 inch or 17.8 cm casing.

The coiled tubing rig in one example can utilize a 4¾ inch or 12 cm polycrystalline diamond compact (PDC) drill bit and downhole mud motor to drill to the depth and into the targeted zone-specific aquifer with the horizontal wellbore and any laterals. A continuous gamma ray geophysical logging tool connected with the downhole mud motor can be utilized to verify that the drilling BHA remains in a clean portion of the targeted zone. The logging tool can continuously log during the drilling process. In addition to the gamma ray logging tool, resistivity and nuclear magnetic resonance logging tools may be used to help steer the offset wellbore and drill string therein, so that the offset wellbore stays in a desired zone (such as, for water wells, in a sandstone layer between shale layers) while drilling.

In one aspect, the offset wellbore can be steered toward the target wellbore while remaining on (beneath) selected property or properties (such as, municipal property, an easement, etc., on which the drilling is permitted), and while remaining in a desired formation zone. After intersection with the target wellbore, the offset wellbore can continue to be drilled while remaining on the selected property or properties.

In one example, a geolocating tool can be installed in the vertical production wellbore to guide the coiled tubing drilling BHA to intersect the vertical production wellbore. In this example, the 4¾ inch (12 cm) mud motor drill bit assembly continuously drills in the zone-specific aquifer. Once the vertical production wellbore is intersected, additional horizontal wellbore and laterals can be drilled in the zone-specific aquifer to open up as much of the targeted clean aquifer as practical (e.g., 1500-5000 feet or 450-1524 m).

An operator at the surface can obtain an indication of the impending or accomplished intersection of the offset wellbore with the target wellbore by observing fluids present in the target wellbore. For example, a level of fluid in the target wellbore may change (rise or descend) due to fluid exchange with the offset wellbore. As another example, a color and/or a solids content of the fluid in the target wellbore may change and/or a solids content of the fluid may change as an indication of the impending or accomplished intersection of the offset wellbore with the target wellbore.

A camera may be included in the drill string bottom hole assembly for use in verifying whether an intersection has been accomplished. Alternatively, or in addition, a camera may be deployed in the target wellbore to verify whether the intersection has been accomplished. The camera may be included with a sensor package (such as the type used with ranging, or conventional measurement while drilling (MWD) or logging while drilling (LWD) tools) in one or both of the offset and target wellbores.

A typical vertical municipal water well will have around 100 feet (30.5 m) of well screen open to multiple aquifer zones penetrated by the water well. This amounts to approximately 471 square feet (43.7 $m^2$) of open aquifer area that will allow water to enter the well from various different zones. With an example horizontal wellbore and laterals of approximately 2000 feet (610 m) linear distance drilled in a single high quality highly productive zone in the aquifer, the open area would be approximately 2487 square feet (231 $m^2$). The open area in a zone that supplies water to the production well directly correlates to higher water production, in this case up to five times the water production.

The temporary 5½ inch (14 cm) vertical pilot hole can then be plugged back, if needed or required, and the remaining 16 inch (40.6 m) vertical production well is then developed and cleaned to be put on production for the municipality to sell to its customers. Alternatively, if the offset wellbore remains open, it provides the opportunity to perform lateral clean-outs and/or stimulations of the horizontal sections.

The systems and methods described herein can be used for municipal water wells, but the systems and methods may also be used for other types of wells (such as, agricultural, industrial or private water wells, wells with no or limited access from the surface into the target wellbore, aquifer, etc.). The systems and methods described herein can be used in situations in which a wellhead at the surface may be gone, or the well may be experiencing a blowout.

The systems and methods described herein provide for increasing production from existing degraded or new water wells. In some examples, the need for repetitive infrastructure is eliminated, with larger than normal water well production.

The systems and methods described herein can be used in populated neighborhoods and in tight spaces. Horizontal wellbores and laterals can be located under city owned property and easements or right of ways.

In the systems and methods described herein, a horizontal wellbore can be steered, so that, for example, the wellbore follows an ancient river channel aquifer or other desirable zone geometry in an aquifer.

In the systems and methods described herein, existing infrastructure (such as, pipelines, electrical service, well housing, etc.) can still be used for production after the secondary wellbore is drilled.

In the systems and methods described herein, discrete zones can be targeted for high quantity and quality of water. Poor quality water intrusion (coning) around seawater can be greatly reduced or eliminated.

In the systems and methods described herein, continuous gamma, resistivity, etc., logging can be used while drilling to ensure that the drilling BHA remains in high quality reservoir rock. Steerable drilling tools can be used to directionally drill the horizontal wellbore where desired. Continuous zone sampling may also be used to confirm whether the drilling BHA remains in the high quality target zone.

In the systems and methods described herein, the vertical or target wellbore is intersected by the secondary or offset wellbore. Ranging and well targeting equipment and operations can be used to help steer the secondary wellbore toward the main wellbore. Using the principles described herein, the drilling and ranging operations can be performed while a drill string (such as, a coiled tubing conveyed drill string) remains in the offset wellbore. The drilling and ranging operations can be performed in a single trip of the drill string into the offset wellbore.

In some examples, the intersection between the target and offset wellbores may not occur in an unconsolidated zone. For example, for reasons of wellbore stability or milling into the target wellbore casing, it may be desirable to form the intersection in a consolidated zone (whether or not that consolidated zone is a water producing zone). Note that, in many cases, it will be desirable to intersect the target wellbore in an open hole portion of the target wellbore. However, the target wellbore may be cased at the intersection in some examples.

In the systems and methods described herein, horizontal wellbore lengths of greater than 1000 feet (305 m) can be used. Flow testing may be conducted as each lateral wellbore is drilled.

In the systems and methods described herein, the productive aquifer may be cored (core samples taken) during the horizontal wellbore drilling operation. One or more cores may be taken in the horizontal portion of the offset wellbore.

After drilling, the horizontal and any lateral wellbores are cleaned out. Sodium hypochlorite and/or other cleaning/stimulation agents may be spotted in each horizontal and lateral wellbore for disinfection and/or production enhancement. The BHA can be configured to navigate multi-lateral wellbores, for example, using an orienter tool to direct the BHA toward a selected lateral wellbore.

Referring specifically now to FIG. 1, a partially cross-sectional view of a first example of a water well system 10 and method is representatively illustrated. In this example, it is desired to increase production of water from an existing water well 12. The water produced from the well 12 may be used for municipal, agricultural, industrial, private or other purposes.

The well 12 includes a wellbore 14 that penetrates a subterranean aquifer 16. The wellbore 14 in this example is substantially vertical, but in other examples the wellbore could be inclined relative to vertical. An upper portion of the wellbore 14 is lined with casing 18 and cement 20.

In order to increase the water production from the well 12, an offset well 22 is drilled to intersect the wellbore 14. The offset well 22 includes an offset wellbore 24 that is drilled so that it intersects the wellbore 14. Thus, the wellbore 14 is referred to herein as a "target" wellbore.

In the FIG. 1 example, the offset wellbore 24 is drilled using a coiled tubing rig 26. Continuous coiled tubing 28 is stored on a spool 30 at the surface. The coiled tubing 28 is deployed into the offset well 22 through an injector head 32 and blowout preventer stack 34. In other examples, other types of drilling rigs or other types of coiled tubing rigs may be used.

As depicted in FIG. 1, an upper portion of the offset wellbore 24 is substantially vertical, the offset wellbore bends or curves to a more horizontal orientation, and the offset wellbore extends substantially horizontally through the aquifer 16. In other examples, the upper portion of the offset wellbore 24 may be inclined from vertical, and the portion extending through the aquifer 16 may be inclined from horizontal. Thus, it will be appreciated that the scope of this disclosure is not limited to any particular details of the well system 10 as depicted in FIG. 1 or described herein.

In the FIG. 1 example, the offset wellbore 24 extends a substantial distance through the aquifer 16, thereby exposing a substantial surface area of the aquifer to the offset wellbore. The offset wellbore 24 intersects the target wellbore 14, and so the water produced from the aquifer surface area exposed to the offset wellbore 24 can be produced to the surface via the target wellbore 14.

As depicted in FIG. 1, the offset wellbore 24 intersects the target wellbore 14 in the aquifer 16. In other examples, it may be desirable for the offset wellbore 24 to intersect the target wellbore 14 in an earth formation other than the aquifer 16.

In the FIG. 1 example, the offset wellbore 24 extends substantially straight through the aquifer 16, and extends past the target wellbore 14. In other examples, the offset wellbore 24 may bend or curve in different directions in the aquifer 16 (for example, to follow a high water quality zone of the aquifer, to follow a relatively high productivity ancient river channel in the aquifer, etc.).

To drill the offset wellbore 24 and steer it toward the target wellbore 14, a drilling bottom hole assembly (BHA) 36 is connected at a distal end of the coiled tubing 28. In this example, the BHA 36 includes a drill bit 38, a mud motor 40, a steering tool 42, ranging equipment 44, and logging tools 46. Other tools or equipment, and other combinations of tools, may be used in other examples.

The logging tools 46 can include continuous gamma, resistivity, nuclear magnetic resonance and/or other types of logging tools. The outputs of the logging tools 46 may be used to determine how to steer the offset wellbore 24, so that it follows a high water quality zone of the aquifer 16, so that it follows a relatively high productivity ancient river channel in the aquifer, etc. However, the scope of this disclosure is not limited to any particular purpose or combination of purposes for use of the logging tools 46.

The ranging equipment 44 may include equipment for active or passive ranging to the target wellbore 14. For example, the ranging equipment 44 could include a magnetometer, a rotating magnet, a current injection tool or another type of ranging equipment. The ranging equipment 44 is used in the FIG. 1 system to determine how to steer the offset wellbore 24, so that it intersects the target wellbore 14.

Ranging equipment 48 may also be used in the target wellbore 14. For example, the ranging equipment 48 could include a magnetometer (e.g., to detect a magnetic field produced from a rotating magnet of the ranging equipment 44 in the offset wellbore 24), a magnet, a current injection tool (e.g., to inject current into the casing 18 if it is near or at the desired wellbore intersection, or to inject current directly into the earth) or another type of ranging equipment.

Note that the drilling and ranging operations can be performed while the coiled tubing 28 remains in the offset wellbore 24. The drilling and ranging operations can be performed in a single trip of the coiled tubing 28 with the BHA 36 into the offset wellbore 24.

The steering tool 42 is used to steer the drill bit 38 and thereby steer the drilling of the offset wellbore 24. Various different types of steering tools are commercially available and known to those skilled in the art.

The BHA 36 can also include an orienter tool to selectively rotate the BHA downhole of the orienter tool. The orienter tool can be used to rotate the ranging equipment 48 as desired relative to the target wellbore 14, or to direct the BHA 36 toward a selected lateral wellbore in some examples.

The mud motor 40 is used to rotate the drill bit 38 and thereby drill the offset wellbore 24. Fluid circulated through the coiled tubing 28 causes the mud motor 40 to rotate the drill bit 38. The fluid exits nozzles in the drill bit 38 and returns to the surface via an annulus formed between the wellbore 24 and the coiled tubing 28.

Referring additionally now to FIGS. 2A-J, plan views of various additional well system 10 examples are representatively illustrated. In each of these examples, at least one offset wellbore 24 is drilled to intersect at least one target wellbore 14. The offset wellbore 24 extends substantially horizontally through the aquifer 16 before and/or after the offset wellbore intersects the target wellbore 14.

Figure 2A:
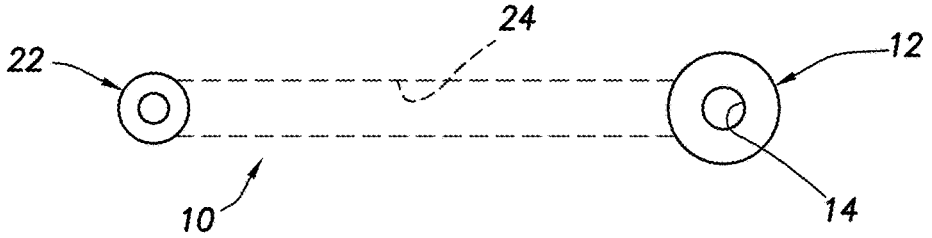
FIGS. 2A-J are representative plan views of various example wellbore configurations which can embody principles of this disclosure.

In FIG. 2A, the offset wellbore 24 extends horizontally through the aquifer 16 (see FIG. 1) before intersecting the target wellbore 14. The FIG. 2B well system 10 is similar to FIG. 2A, but the offset wellbore 24 also extends through the aquifer 16 after intersecting the target wellbore 14.

Figure 2B:
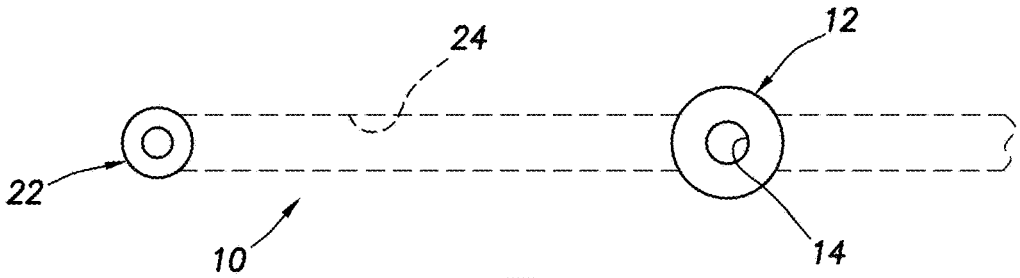
Figure 2C:
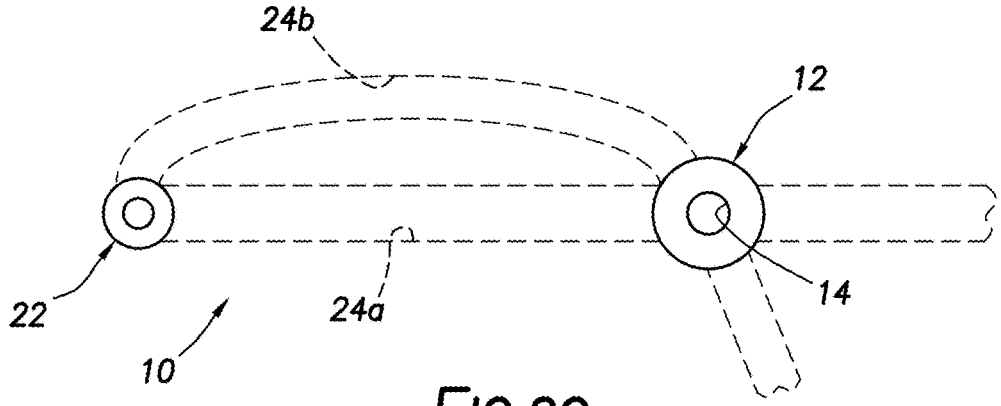

In FIG. 2C, a first offset wellbore 24*a* is drilled as in FIG. 2B. Another offset wellbore 24*b* is drilled as a lateral or sidetrack of the first offset wellbore 24*a* (for example, in an upper generally vertical portion of the wellbore 24*a*). The second offset wellbore 24*b* is drilled so that it extends generally horizontally through the aquifer 16 before and after intersecting the target wellbore 14.

Figure 2D:
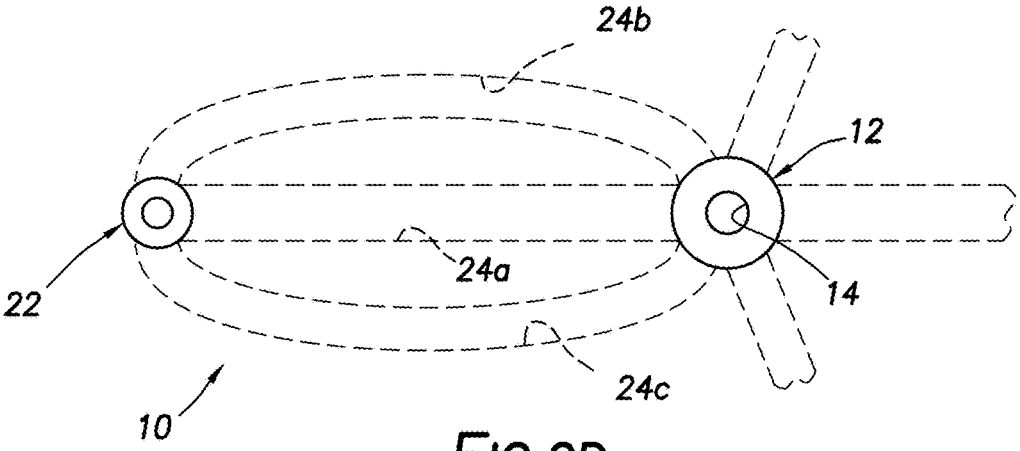

The FIG. 2D well system 10 is similar to FIG. 20, but a third offset wellbore 24*c* is drilled as a lateral or sidetrack of the first wellbore 24*a*. The third offset wellbore 24*c* is drilled so that it extends generally horizontally through the aquifer 16 before and after intersecting the target wellbore 14.

Figure 2E:
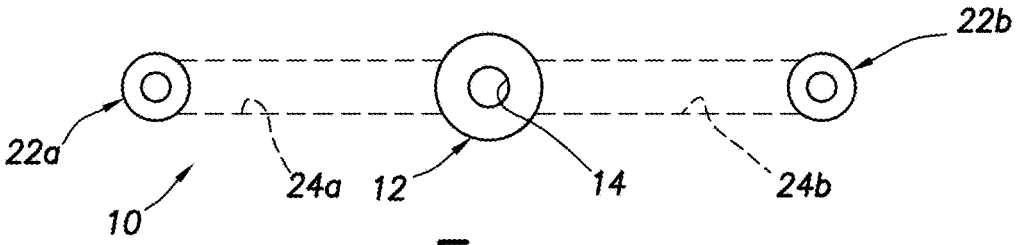

In FIG. 2E, two offset wells 22*a,b* are drilled. The first offset well 22*a* includes a first offset wellbore 24*a* that intersects the target wellbore 14, and the second offset well 22*b* includes a second offset wellbore 24*b* that intersects the target wellbore 14. The offset wellbores 24*a,b* do not necessarily intersect the target wellbore 14 at the same location or in the same aquifer 16 (for example, see FIGS. 6, 12 & 13).

Figure 2F:
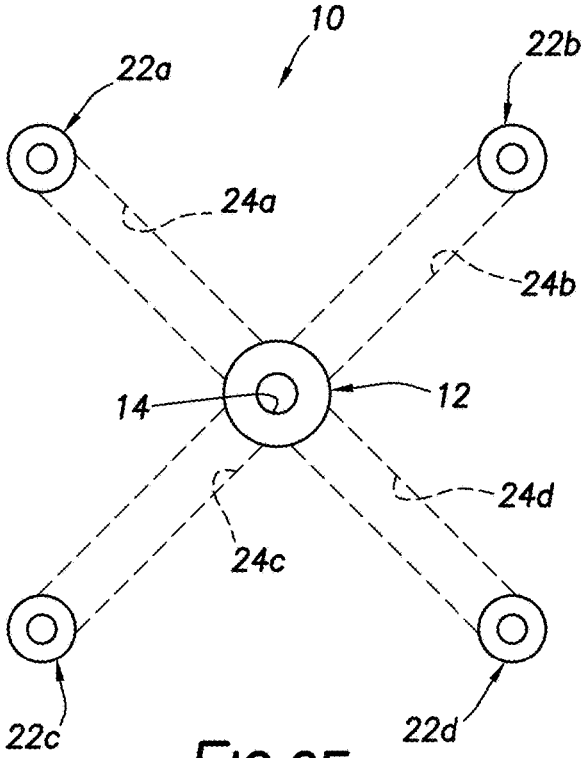

The FIG. 2F well system 10 is similar to FIG. 2E, but a third and a fourth offset wellbores 22*c,d* are drilled to intersect the target well 12. The offset wells 22*c,d* include respective offset wellbores 24*c,d* which intersect the target wellbore 14. The offset wellbores 24*c,d* do not necessarily intersect the target wellbore 14 at the same location or in the same aquifer 16.

Figure 2G:
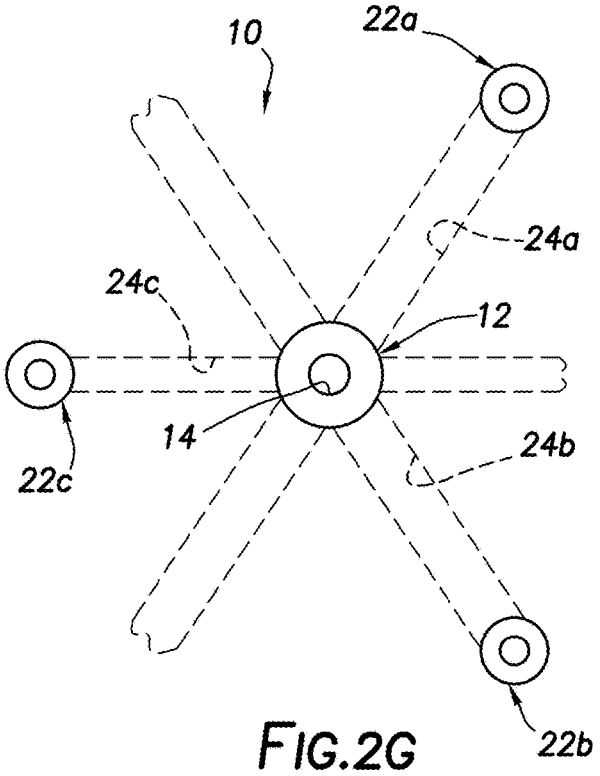
Figure 2H:
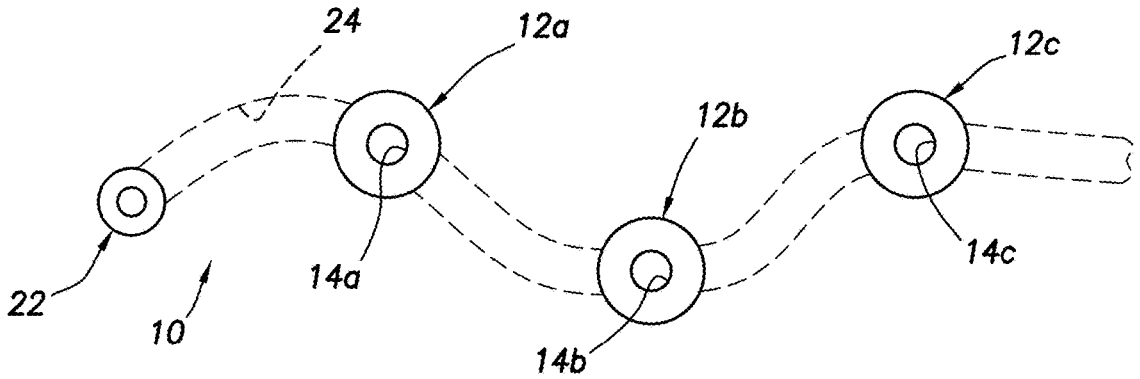

In the FIG. 2G well system 10, only three offset wells 22*a-c* are used. However, their respective offset wellbores 24*a-c* extend past their intersection(s) with the target wellbore 14. In the FIG. 2H well system 10, an offset wellbore 24 of a single offset well 22 is drilled so that it intersects multiple target wellbores 14*a-c* of respective target wells 12*a-c*.

Figure 2I:
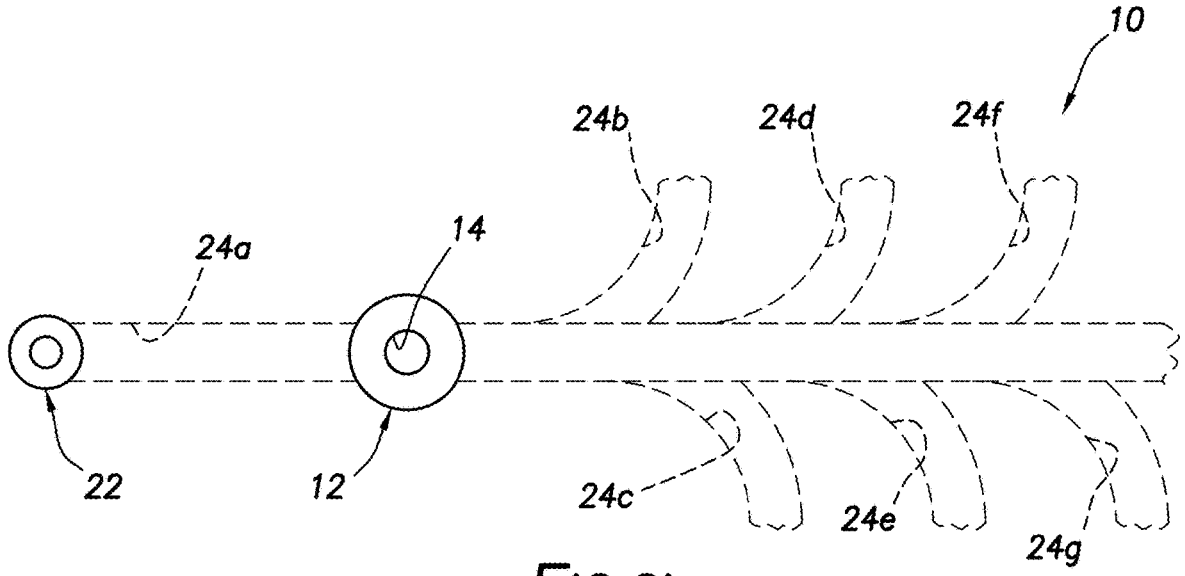

In the FIG. 2I well system 10, an offset wellbore 24*a* is drilled to intersect and extend past the target wellbore 14. Multiple lateral wellbores 24*b-g* are drilled from the offset wellbore 24*a*. The lateral wellbores 24*b-g* increase the surface area of the aquifer 16 exposed to the offset wellbore 24*a*.

Figure 2J:
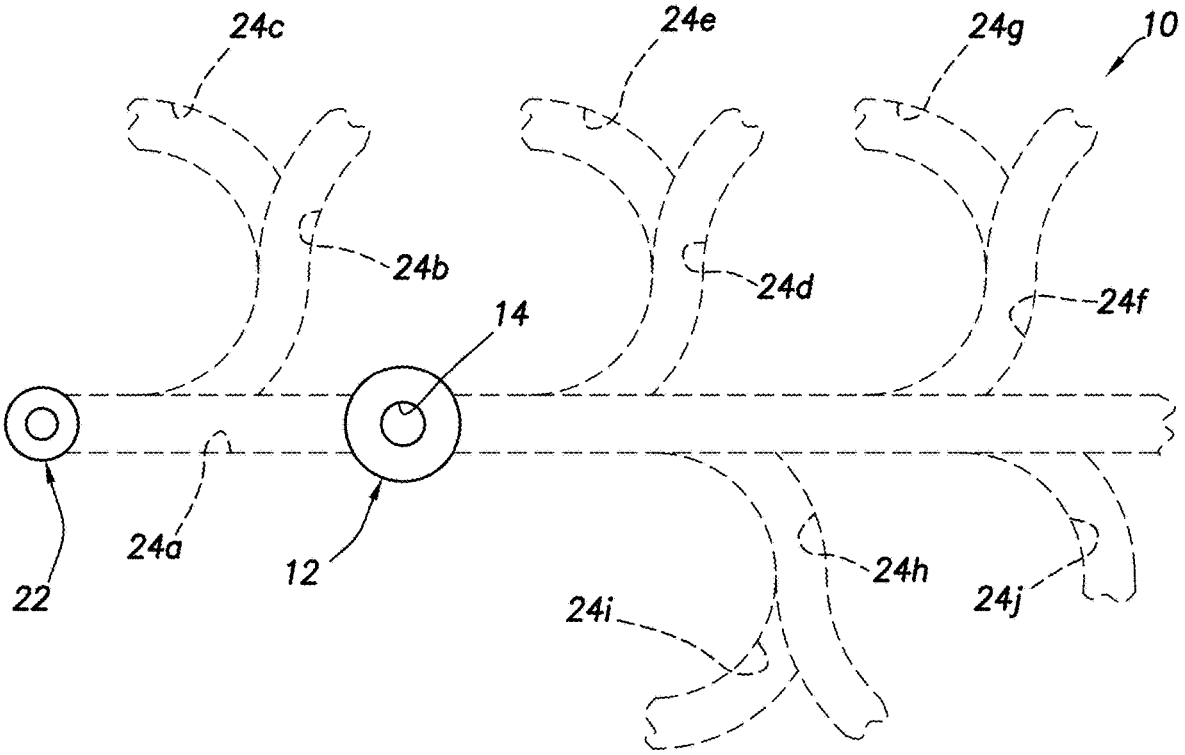

The FIG. 2J well system 10 is similar to FIG. 2I. However, lateral wellbores 24*b,c* are drilled from the offset wellbore 24*a* on one side of its intersection with the target wellbore 14, and lateral wellbores 24*d-j* are drilled from the offset wellbore 24*a* on an opposite side of the target wellbore 14. The lateral wellbores 24*c,e,g,i* are drilled from the respective lateral wellbores 24*b,d,f,h*.

Figure 3:
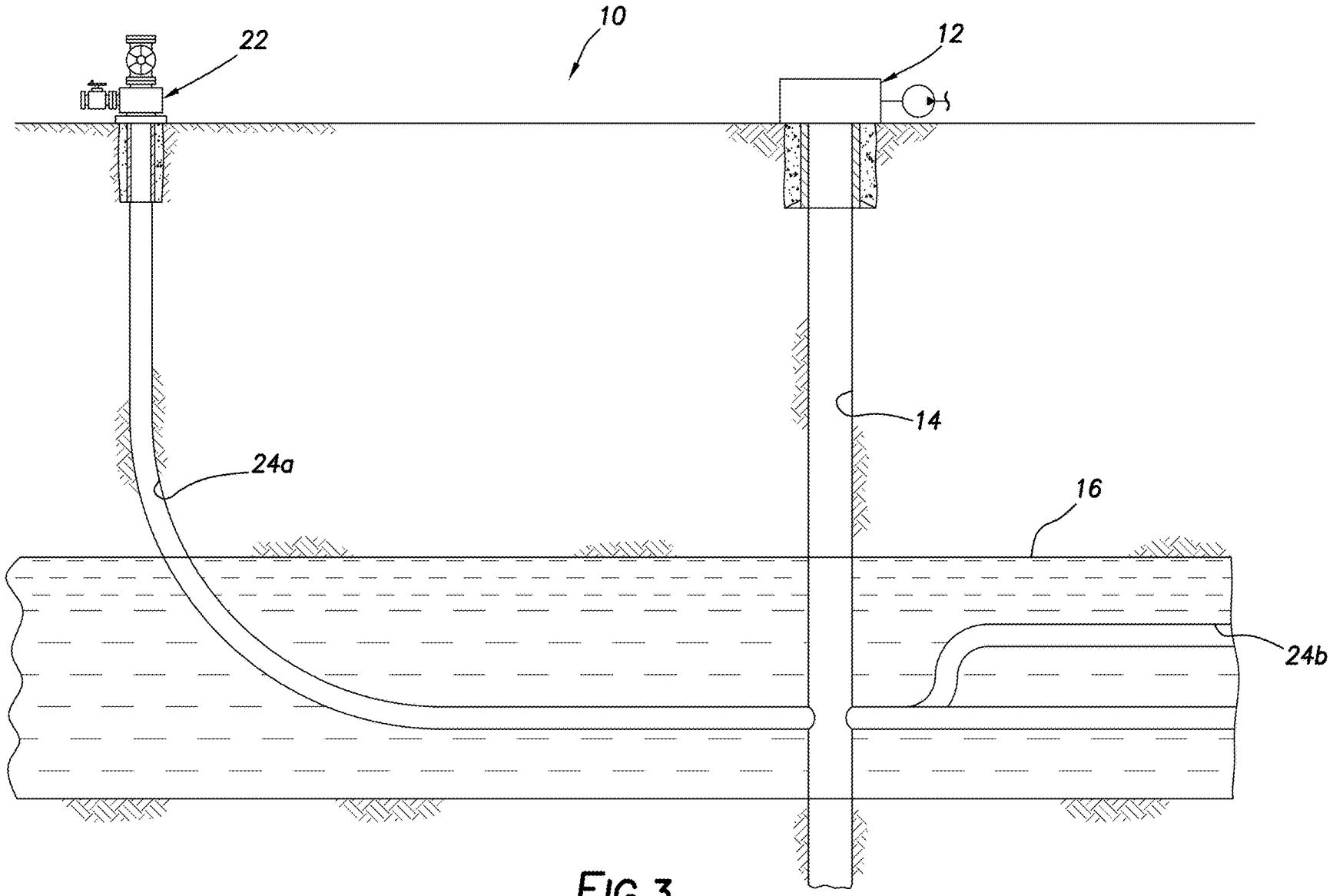
FIGS. 3 & 4 are representative partially cross-sectional views of additional example wellbore configurations.

Referring additionally now to FIG. 3, a partially cross-sectional view of another example of the well system 10 and method is representatively illustrated. In the FIG. 3 example, an offset wellbore 24*a* is drilled to intersect and extend past the target wellbore 14. The offset wellbore 24*a* extends generally horizontally through the aquifer 16 before and after its intersection with the target wellbore 14.

A lateral wellbore 24*b* is drilled from the offset wellbore 24*a* on one side of the target wellbore 14. A substantial portion of the lateral wellbore 24*b* extends generally horizontally through the aquifer 16.

Referring additionally now to FIG. 4, a partially cross-sectional view of another example of the well system 10 and method is representatively illustrated. The FIG. 4 example is similar to the FIG. 3 example. However, in the FIG. 4 well system 10, the offset wellbore 24*a* extends generally horizontally through a lower aquifer 16*a* before and after its intersection with the target wellbore 14.

A substantial portion of the lateral wellbore 24*b* extends generally horizontally through an upper aquifer 16*b*. The lateral wellbore 24*b* provides additional surface area exposure of the target wellbore 14 to the upper aquifer 16*b*, without requiring an additional intersection with the target wellbore.

Referring additionally now to FIG. 5, a plan view of another example of the well system 10 and method is representatively illustrated. In the FIG. 5 example, an existing water well 12 is located on municipal property 50. Due to the dimensions of the municipal property 50, the offset wellbore 24 cannot extend a substantial distance in the aquifer 16 while remaining under the municipal property.

However, the municipal property 50 is adjacent to a roadway easement 52, which intersects a railroad easement 54. The municipality (e.g., the owner of the property 50) has or can obtain access to the easements 52, 54. Thus, the offset wellbore 24 can be drilled to intersect the target wellbore 14 under the municipal property 50, and can further extend under the roadway and railroad easements 52, 54 to thereby substantially increase the surface area of the aquifer 16 exposed to the target and offset wellbores 14, 24. In this example, the offset wellbore 24 extends substantially horizontally in the aquifer 16 before and after its intersection with the target wellbore 14.

Referring additionally now to FIGS. 6-13, partially cross-sectional views of additional examples of the well system 10 and method are representatively illustrated. In the FIG. 6 example, multiple offset wellbores 24*a,b* are drilled to intersect and extend past the target wellbore 14 at separate locations. The offset wellbore 24*a* extends generally horizontally through, and intersects the target wellbore 14 in, a lower aquifer 16*a*. The offset wellbore 24*b* extends generally horizontally through, and intersects the target wellbore 14 in, an upper aquifer 16*b*.

In the FIG. 7 example, the offset wellbore 24 is drilled so that it intersects and extends past the target wellbore 14. The offset wellbore 24 extends substantially horizontally in the aquifer 16 on both sides of the target wellbore 14. However, the offset wellbore 24 is inclined downward somewhat toward the target wellbore 14 on both sides of the target wellbore, so that water drains downwardly through the offset wellbore toward the target wellbore.

In the FIG. 8 example, the offset wellbore 24 intersects multiple target wellbores 24*a,b*. As depicted in FIG. 8, the offset wellbore 24 extends generally horizontally through the aquifer 16 on both sides of each of the target wellbores 14*a,b* and intersects the target wellbores in the aquifer.

In the FIG. 9 example, an offset wellbore 24*a* is drilled to intersect a target wellbore 14*a*. The offset wellbore 24*a* extends generally horizontally through the aquifer 16 on both sides of the target wellbore 14*a* and intersects the target wellbore 14*a* in the aquifer 16. A lateral wellbore 24*b* is drilled from the offset wellbore 24*a* to intersect another target wellbore 14*b*. The lateral wellbore 24*b* extends generally horizontally through the aquifer 16 on both sides of the target wellbore 14*b* and intersects the target wellbore 14*b* in the aquifer 16.

In the FIG. 10 example, a substantially vertical offset wellbore 24*a* is drilled. Lateral wellbores 24*b,c* are drilled from the offset wellbore 24*a*. The lateral wellbores 24*b,c* extend generally horizontally through the aquifer 16 on both sides of the target wellbore 14 and intersect the target wellbore 14 in the aquifer 16.

In the FIG. 11 example, a substantially vertical offset wellbore 24*a* is drilled. A lateral wellbore 24*b* is drilled from the offset wellbore 24*a*. Another lateral wellbore 24*c* is drilled from the lateral wellbore 24*b*. The lateral wellbores 24*b,c* extend generally horizontally through the aquifer 16 on both sides of the target wellbore 14 and intersect the target wellbore 14 in the aquifer 16.

Figure 12:
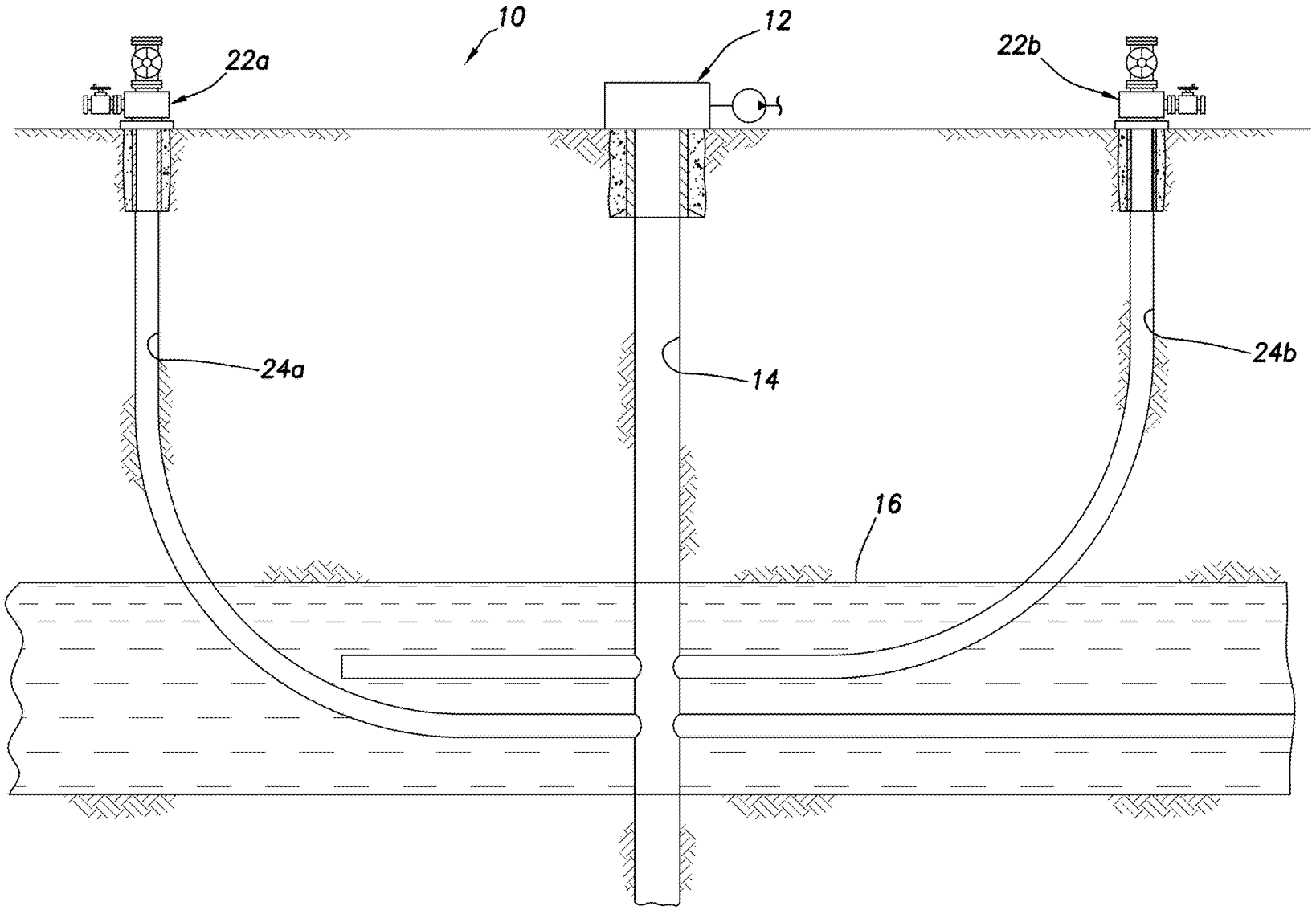

In the FIG. 12 example, multiple offset wellbores 24*a,b* are drilled to intersect the target wellbore 14 at separate locations. The offset wellbores 24*a,b* extend generally horizontally through the aquifer 16 on both sides of the target wellbore 14 and intersect the target wellbore 14 in the aquifer 16.

In the FIG. 13 example, multiple offset wellbores 24*a,b* are drilled to intersect multiple target wellbores 14*a,b* at respective separate locations. The offset wellbores 24*a,b* extend generally horizontally through the aquifer 16 on both sides of the target wellbores 14*a,b* and intersect the target wellbore 14*a,b* in the aquifer 16.

In the examples described above, the lateral wellbores can also be considered offset wellbores, since they are drilled from the offset well 22 to intersect the target wellbore(s) 14, and/or to increase a surface area of the aquifer 16 exposed to the target wellbore. The term "lateral" is used to indicate that each of the lateral wellbores is drilled from an intersection with another offset wellbore.

It may now be fully appreciated that the above disclosure provides significant advancements to the art of increasing production from water wells. In examples described above, a surface area of an aquifer 16 exposed to a production wellbore 14 is substantially increased by drilling an offset wellbore 24 to intersect the production wellbore 14.

The above disclosure provides to the art a method of increasing production from at least one target wellbore 14. In one example, the method can comprise: drilling at least one offset wellbore 24 having at least one horizontal portion in at least one aquifer 16; and intersecting the target wellbore 14 with the offset wellbore 24.

The intersecting step may include an intersection between the target and offset wellbores 14, 24 being positioned in the aquifer 16. The horizontal portion of the offset wellbore 24 may extend past the intersection.

The drilling step may include connecting a bottom hole assembly 36 to a coiled tubing string 28. The drilling step may include steering the bottom hole assembly 36, thereby maintaining the offset wellbore 24 horizontal portion in the aquifer 16.

The bottom hole assembly 36 may comprise ranging equipment 44. The ranging equipment 44 may comprise a magnetometer, a rotating magnet and/or a current injection tool.

The method may include positioning ranging equipment 48 in the target wellbore 14. The ranging equipment 48 may comprise a magnetometer, a current injection tool and/or a magnet.

The "at least one" target wellbore 14 may comprise multiple target wellbores 14*a,b*. The intersecting step may include intersecting each of the target wellbores 14*a,b* with the offset wellbore 24.

The "at least one" offset wellbore 24 may comprise multiple offset wellbores 24*a,b*. The intersecting step may include intersecting the target wellbore 14 with each of the offset wellbores 24*a,b*.

The intersecting step may include intersecting the target wellbore 14 with the horizontal portion of the offset wellbore 24.

The drilling step may include drilling the offset wellbore 24 under surface property 50 owned by a municipality. The drilling step may include drilling the offset wellbore 24 under surface property for which a municipality has an easement 52, 54.

The method may include producing water from the target wellbore 14 after the intersecting step.

The "at least one" offset wellbore 24 may comprise multiple offset wellbores 24*a,b*, and the "at least one" aquifer 16 may comprise multiple aquifers 16*a,b*. The drilling step may include drilling each of the offset wellbores 24*a,b* in a respective one of the aquifers 16*a,b*.

The "at least one" offset wellbore 24 may comprise multiple offset wellbores 24*a,b*. The drilling step may include drilling at least one of the offset wellbores 24*a,b* from an intersection with another one of the offset wellbores 24*a,b*.

The method may comprise performing the drilling and intersecting steps in a single trip of the coiled tubing string 28 into the offset wellbore 24. The above disclosure also provides to the art a water well system 10 for improved production from at least one target wellbore 14. In one example, the system 10 can comprise: at least one offset wellbore 24, the offset wellbore 24 including at least one horizontal portion positioned in at least one aquifer 16; and at least one intersection between the offset wellbore 24 and the target wellbore 14.

Water is produced from the target wellbore 14.

The intersection may be positioned in the aquifer 16. The horizontal portion of the offset wellbore 24 may extend past the intersection. The intersection may be between the target wellbore 14 and the horizontal portion of the offset wellbore 24.

The water well system 10 may include a bottom hole assembly 36 connected to a coiled tubing string 28 in the offset wellbore 24. The bottom hole assembly 36 may include ranging equipment 44. The ranging equipment 44 may comprise a magnetometer, a rotating magnet and/or a current injection tool.

The water well system 10 may include ranging equipment 48 positioned in the target wellbore 14. The ranging equipment 48 may comprise a magnetometer, a current injection tool and/or a magnet.

The "at least one" target wellbore 14 may comprise multiple target wellbores 14*a,b*. The "at least one" intersection may comprise intersections between each of the target wellbores 14*a,b* and the offset wellbore 24.

The "at least one" offset wellbore 24 may comprise multiple offset wellbores 24*a,b*. The "at least one" intersection may comprise intersections between the target wellbore 14 and each of the offset wellbores 24*a,b*.

The intersection may be between the target wellbore 14 and the horizontal portion of the offset wellbore 24.

The offset wellbore 24 may extend under surface property 50 owned by a municipality. The offset wellbore 24 may extend under surface property for which a municipality has an easement 52, 54.

The "at least one" offset wellbore 24 may comprise multiple offset wellbores 24*a,b*. The "at least one" aquifer 16 may comprise multiple aquifers 16*a,b*. Each of the offset wellbores 24*a,b* may extend in a respective one of the aquifers 16*a,b*.

The "at least one" offset wellbore 24 may comprise multiple offset wellbores 24*a,b*. At least one of the offset wellbores 24*a,b* may intersect another one of the offset wellbores 24*a,b*.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of increasing production from at least one target wellbore, the method comprising:

drilling at least one offset wellbore having at least one horizontal portion in at least one aquifer, in which a majority of the horizontal portion is positioned underneath and longitudinally follows at least one of the group consisting of a roadway, a railway, and a power line; and intersecting the target wellbore with the offset wellbore.

2. The method of claim 1, in which the intersecting comprises an intersection between the target and offset wellbores being positioned in the aquifer.

3. The method of claim 2, in which the horizontal portion extends past the intersection.

4. The method of claim 1, in which the drilling comprises connecting a bottom hole assembly to a coiled tubing string.

5. The method of claim 4, in which the bottom hole assembly comprises ranging equipment.

6. The method of claim 5, in which the ranging equipment is selected from the group consisting of a magnetometer, a rotating magnet and a current injection tool.

7. The method of claim 4, further comprising positioning ranging equipment in the target wellbore.

8. The method of claim 7, in which the ranging equipment is selected from the group consisting of a magnetometer, a current injection tool and a magnet.

9. The method of claim 4, in which the drilling comprises steering the bottom hole assembly, thereby maintaining the offset wellbore horizontal portion in the aquifer.

10. The method of claim 4, in which the drilling and intersecting steps are performed in a single trip of the coiled tubing string into the offset wellbore.

11. The method of claim 1, in which the at least one target wellbore comprises multiple target wellbores, and in which the intersecting comprises intersecting each of the target wellbores with the offset wellbore.

12. The method of claim 1, in which the at least one offset wellbore comprises multiple offset wellbores, and in which the intersecting comprises intersecting the target wellbore with each of the offset wellbores.

13. The method of claim 1, in which the intersecting comprises intersecting the target wellbore with the horizontal portion of the offset wellbore.

14. The method of claim 1, in which the at least one of the group consisting of a roadway, a railway, and a power line is located on surface property owned by a municipality.

15. The method of claim 1, in which the at least one of the group consisting of a roadway, a railway, and a power line is located on surface property for which a municipality has an easement.

16. The method of claim 1, further comprising producing water from the target wellbore after the intersecting.

17. The method of claim 1, in which the at least one offset wellbore comprises multiple offset wellbores, the at least one aquifer comprises multiple aquifers, and the drilling comprises drilling each of the offset wellbores in a respective one of the aquifers.

18. The method of claim 1, in which the at least one offset wellbore comprises multiple offset wellbores, and in which the drilling comprises drilling at least one of the offset wellbores from an intersection with another one of the offset wellbores.

19. A water well system for improved production from at least one target wellbore, the system comprising:

at least one offset wellbore, the offset wellbore comprising at least one horizontal portion positioned in at least one aquifer, in which a majority of the horizontal portion is positioned underneath and longitudinally follows at least one of the group consisting of a roadway, a railway, and a power line; and at least one intersection between the offset wellbore and the target wellbore.

20. The water well system of claim 19, in which the intersection is positioned in the aquifer.

21. The water well system of claim 19, in which the horizontal portion extends past the intersection.

22. The water well system of claim 19, in which the intersection is between the target wellbore and the horizontal portion of the offset wellbore.

23. The water well system of claim 19, further comprising a bottom hole assembly connected to a coiled tubing string in the offset wellbore.

24. The water well system of claim 23, in which the bottom hole assembly comprises ranging equipment.

25. The water well system of claim 24, in which the ranging equipment is selected from the group consisting of a magnetometer, a rotating magnet and a current injection tool.

26. The water well system of claim 23, further comprising ranging equipment positioned in the target wellbore.

27. The water well system of claim 26, in which the ranging equipment is selected from the group consisting of a magnetometer, a current injection tool and a magnet.

28. The water well system of claim 19, in which the at least one target wellbore comprises multiple target wellbores, and in which the at least one intersection comprises intersections between each of the target wellbores and the offset wellbore.

29. The water well system of claim 19, in which the at least one offset wellbore comprises multiple offset wellbores, and in which the at least one intersection comprises intersections between the target wellbore and each of the offset wellbores.

30. The water well system of claim 19, in which the intersection is between the target wellbore and the horizontal portion of the offset wellbore.

31. The water well system of claim 19, in which the at least one of the group consisting of a roadway, a railway, and a power line is located on surface property owned by a municipality.

32. The water well system of claim 19, in which the at least one of the group consisting of a roadway, a railway, and a power line is located on surface property for which a municipality has an easement.

33. The water well system of claim 19, in which water is produced from the target wellbore.

34. The water well system of claim 19, in which the at least one offset wellbore comprises multiple offset wellbores, the at least one aquifer comprises multiple aquifers, and each of the offset wellbores extends in a respective one of the aquifers.

35. The water well system of claim 19, in which the at least one offset wellbore comprises multiple offset wellbores, and in which at least one of the offset wellbores intersects another one of the offset wellbores.

* * * * *